US009116482B2

(12) United States Patent
Inoue et al.

(10) Patent No.: US 9,116,482 B2
(45) Date of Patent: Aug. 25, 2015

(54) IMAGE FORMING APPARATUS

(71) Applicant: CANON KABUSHIKI KAISHA, Tokyo (JP)

(72) Inventors: Koji Inoue, Tokyo (JP); Taku Higashiyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/244,185

(22) Filed: Apr. 3, 2014

(65) Prior Publication Data

US 2014/0301762 A1 Oct. 9, 2014

(30) Foreign Application Priority Data

Apr. 9, 2013 (JP) ..... 2013-081031

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 15/2053; G03G 15/206; G03G 15/2025; G03G 2215/2048; G03G 15/162; G03G 15/2039
USPC ..... 399/333
See application file for complete search history.

(56) References Cited

U.S. PATENT DOCUMENTS 7,558,520 B2 7/2009 Sugawara et al.
2006/0014021 A1 1/2006 Sugawara et al.
2010/0129122 A1* 5/2010 Ciaschi ..... 399/329
2012/0155934 A1* 6/2012 Takeuchi et al. ..... 399/329
2012/0308281 A1* 12/2012 Wu et al. ..... 399/333
2013/0011157 A1* 1/2013 Kaino et al. ..... 399/92

(Continued)

FOREIGN PATENT DOCUMENTS

JP 03107183 A * 5/1991
JP 2005-302691 A 10/2005
JP 2007-219371 A 8/2007

OTHER PUBLICATIONS

Aihara, T., "Heat Transfer Engineering", Shokabo Publishing Co., Ltd., Tokyo, Japan, Sep. 30, 1994, pp. 31-35.

(Continued)

*Primary Examiner* — Francis Gray
(74) *Attorney, Agent, or Firm* — Fitzpatrick, Cella, Harper & Scinto

(57) ABSTRACT

A heating member has a multi-layered structure of n layers in total to which layer numbers are assigned sequentially from one on a heat source side to a surface in contact with a recording medium. An $n^{-th}$ layer is heated by the heat source. The thermal permeability of the $n^{-th}$ layer is larger than the thermal permeability of a $n-1^{-th}$ layer and satisfies the following relationship:

$$\sqrt{\alpha_n t} \leq d_n$$

where, $\alpha_n$[$m^2$/s] is the thermal diffusivity of the $n^{-th}$ layer, and $d_n$[m] is the thickness of the $n^{-th}$ layer.

12 Claims, 19 Drawing Sheets

(56) References Cited

U.S. PATENT DOCUMENTS

| | | | | |
|---|---|---|---|---|
| 2014/0205329 | A1 | 7/2014 | Inoue | |
| 2014/0255068 | A1 * | 9/2014 | Matsunaka et al. | 399/333 |

OTHER PUBLICATIONS

Fukase, K. et al., "Basics and Application Electrophotographic Technology", Corona Publishing Co., Ltd., Tokyo, Japan, Jun. 15, 1988, pp. 192-210.

* cited by examiner

FIG.3A CHANGES OF TEMPERATURE DISTRIBUTION IN DIAMETER DIRECTION AT NIP PORTION
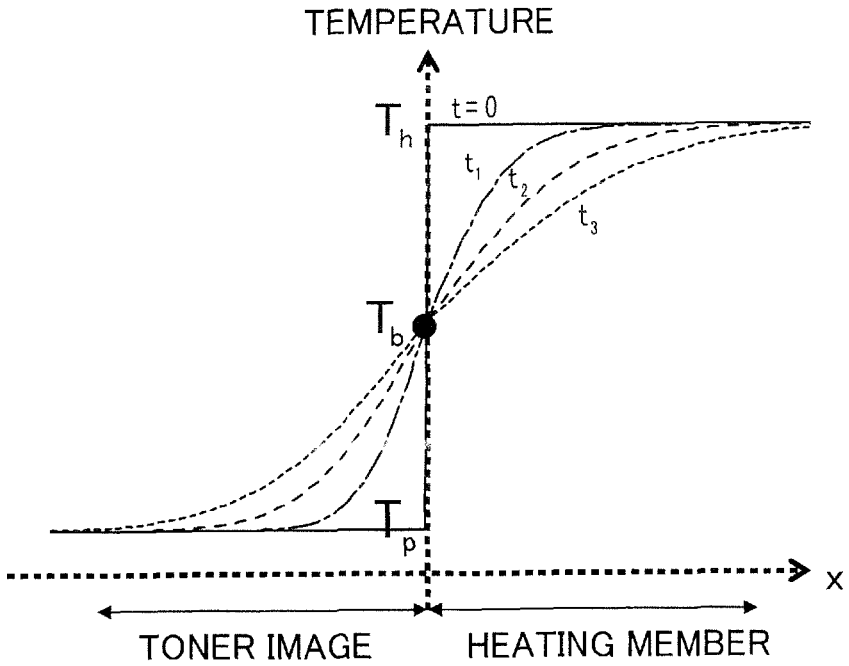
FIG.3B CHANGES OF TEMPERATURE DISTRIBUTION IN DIAMETER DIRECTION OF HEATING MEMBER
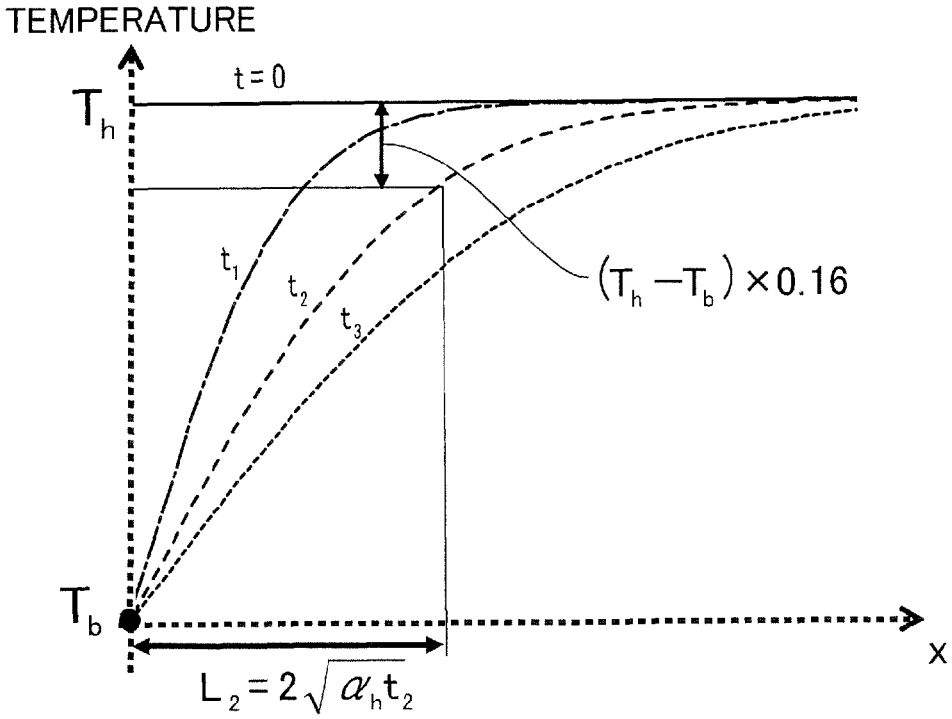

FIG.5A THICKNESS OF RELEASE LAYER: 30 μm
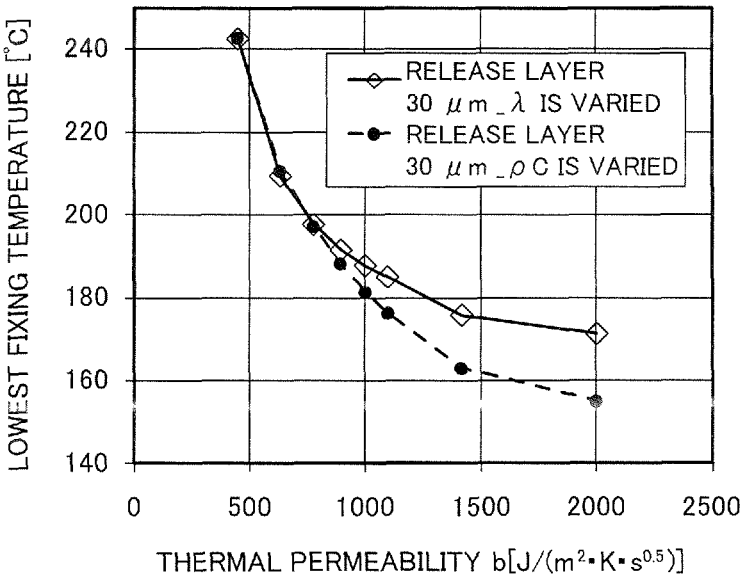
FIG.5B THICKNESS OF RELEASE LAYER: 200 μm
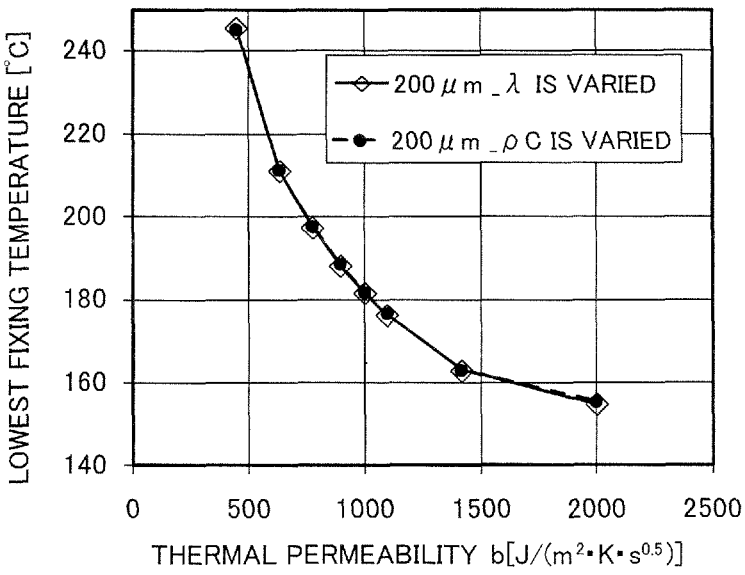

FIG.7A NIP PORTION PASSING TIME
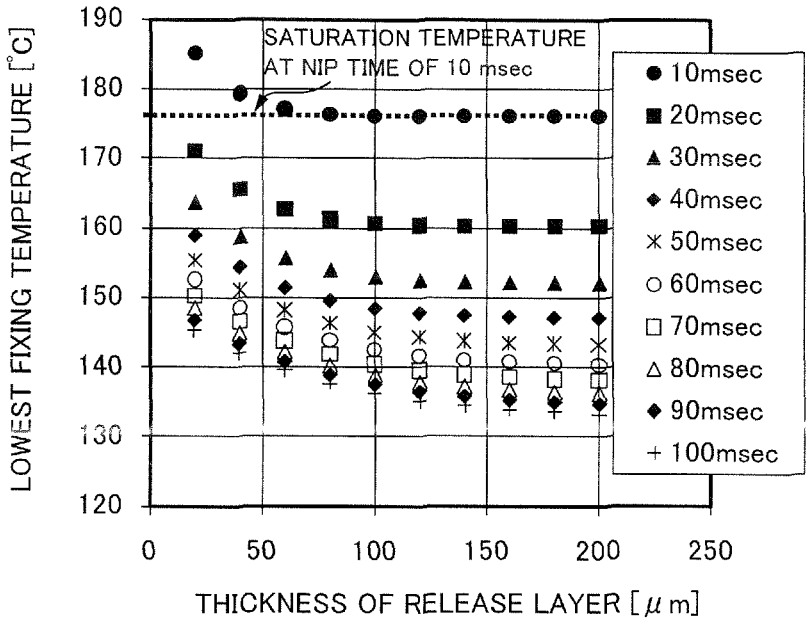
FIG.7B 50 % OF THERMAL DIFFUSION LENGTH
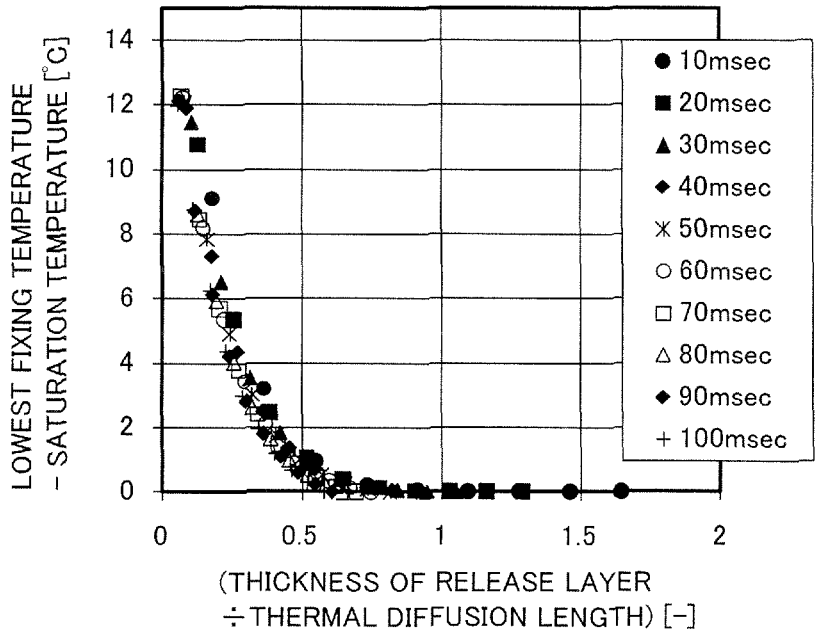

IMAGE FORMING APPARATUS

BACKGROUND OF THE INVENTION

1. Field of the Invention

The present invention relates to an image heating apparatus configured to heat a recording medium at a nip portion between a heating member having an elastic layer and a conveying member, and more specifically to a layer structure of the heating member permitting lowering of a target temperature in temperature control of an outer surface temperature of the heating member without hampering the performance thereof in heating the recording medium.

2. Description of the Related Art

An image forming apparatus configured to transfer a toner image carried on an image carrier to a recording medium and to fix an image on the recording medium by heating and pressing the recording medium on which the toner image has been transferred at a nip portion of a fixing apparatus, i.e., one exemplary image heating apparatus, is being widely used. The image heating apparatus has the nip portion for the recording medium formed by making a conveying member (a roller member or a belt member) come into contact with the heating member (a roller member or a belt member). The heating member is provided with an elastic layer having rubbery elasticity on a base layer (a cylindrical member or a belt member) bearing the strength of the heating member to enhance followability thereof on an uneven surface of the recording medium.

Japanese Patent Application Laid-open No. 2007-219371 enhances the thermal conductivity of a fixing belt in a thickness direction thereof by blending oxide metallic thermal conductive fillers, such as alumina and silica, into a silicone rubber material forming an elastic layer. Japanese Patent Application Laid-open No. 2005-302691 provides a fluorine resin release layer having high releasability to melted toner on an elastic layer and enhances thermal conductivity of the release layer by blending metallic thermal conductive fillers, such as gold and nickel, into the fluorine resin material of the release layer.

If the quality of a heat-processed image and the heat processing speed are same in the image heating apparatus, it is desirable to be able to lower the outer surface temperature of the heating member. The lower the outer surface temperature of the heating member, the less the heat radiated from the whole surface, so that the power required to maintain the outer surface temperature of the heating member can be saved. The lower the outer surface temperature of the heating member, the less the wear rate of the release layer on the surface of the heating member, so that the replacement life of the heating member can be also prolonged.

It was confirmed that it is possible to lower the outer surface temperature of the heating member by lowering a target temperature in temperature control in a case where the thermal conductivity of the release layer is increased, as disclosed in Japanese Patent Application Laid-open No. 2005-302691. However, its effect cannot be said to be sufficient by the thickness of the release layer disclosed in Japanese Patent Application Laid-open No. 2005-302691, and it is necessary to increase the target temperature by a certain degree in the temperature control in order to assure the quality of a heat-processed image and the heat processing speed. Accordingly, it is unable to fully lower the outer surface temperature of the heating member.

SUMMARY OF THE INVENTION

According to a first aspect of the present invention, an image heating apparatus includes a heat source, a heating member heated by the heat source, a conveying member forming a nip portion conveying a recording medium by being in contact with the heating member, the heating member including a base layer heated by the heat source, an elastic layer disposed on the base layer, and a release layer disposed on the elastic layer, and the heating member holding a relationship of the following equation: equation:

$$\sqrt{\alpha_3 t} \leq d_3$$

where, $\lambda_2$[W/(m·K)] is thermal conductivity of the elastic layer, $C_2$[J/(m$^3$·K)] is heat capacity of the elastic layer, $b_2$[J/(m$^2$·K·s$^{0.5}$)]($=\sqrt{\lambda_2 C_2}$) is thermal permeability of the elastic layer, $d_2$[m] is a thickness of the elastic layer, $\lambda_3$[W/(m·K)] is thermal conductivity of the release layer, $C_3$[J/(m$^3$·K)] is heat capacity of the release layer, $b_3$[J/(m$^2$·K·s$^{0.5}$)]($=\sqrt{\lambda_3 C_3}$) is thermal permeability of the elastic layer, $d_3$[m] is a thickness of the release layer, the thermal permeability $b_3$ of the release layer being greater than the thermal permeability $b_2$ of the elastic layer, $\alpha_3$[m$^2$/s] is thermal diffusivity of the release layer, and t [s] is the recording medium stay time at the nip portion.

According to a second aspect of the present invention, an image heating apparatus includes a heat source, a heating member heated by the heat source, a conveying member forming a nip portion conveying a recording medium by being in contact with the heating member, the heating member having a multi-layered structure of n layers in total assigned by layer numbers sequentially from one on the heat source side to the surface in contact with the recording medium, and the heating member holding a relationship of the following equation:

$$\sqrt{\alpha_n t} \leq d_n$$

where, $\lambda_j$[W/(m·K)] is thermal conductivity of a j$^{-th}$ (j=1 to n) layer, $C_j$[J/(m$^3$·K)] is heat capacity of the j$^{-th}$ (j=1 to n) layer, $b_j$[J/(m$^2$·K·s$^{0.5}$)]($=\sqrt{\lambda_j C_j}$) is thermal permeability of the j$^{-th}$ (j=1 to n) layer, $d_j$[m] is a thickness of the j$^{-th}$ (j=1 to n) layer, the thermal permeability $b_n$ of the n$^{-th}$ layer being greater than the thermal permeability $b_{n-1}$ of the fixing roller 1-$n^{-th}$ layer, $\alpha_n$[m$^2$/s] is thermal diffusivity of the j$^{-th}$ (j=1 to n) layer, $d_n$[m] is a thickness of the n$^{-th}$ layer, and t[s] is the recording medium stay time at the nip portion.

Further features of the present invention will become apparent from the following description of exemplary embodiments (with reference to the attached drawings).

BRIEF DESCRIPTION OF THE DRAWINGS

FIG. 3A is a graph indicating the changes of a temperature distribution in a diameter direction at a nip portion.

FIG. 3B is a graph indicating the changes of a temperature distribution in a diameter direction of a heating member.

FIG. 5A is a graph indicating a relationship between a lowest fixing temperature and thermal permeability in a case where the thickness of the release layer is 30 μm.

FIG. 5B is a graph indicating a relationship between the lowest fixing temperature and the thermal permeability in a case where the thickness of the release layer is 200 μm.

FIG. 7A is a graph indicating a relationship between the thickness of the release layer and the lowest fixing temperature.

FIG. 7B is a graph indicating a relationship between the thickness of the release layer and the lowest fixing temperature by consolidating a tendency of the lowest fixing temperature by a thermal diffusion length.

DESCRIPTION OF THE EMBODIMENTS

Embodiments of the present invention will be explained below with reference to the drawings.

First Embodiment

Image Forming Apparatus

Figure 1:
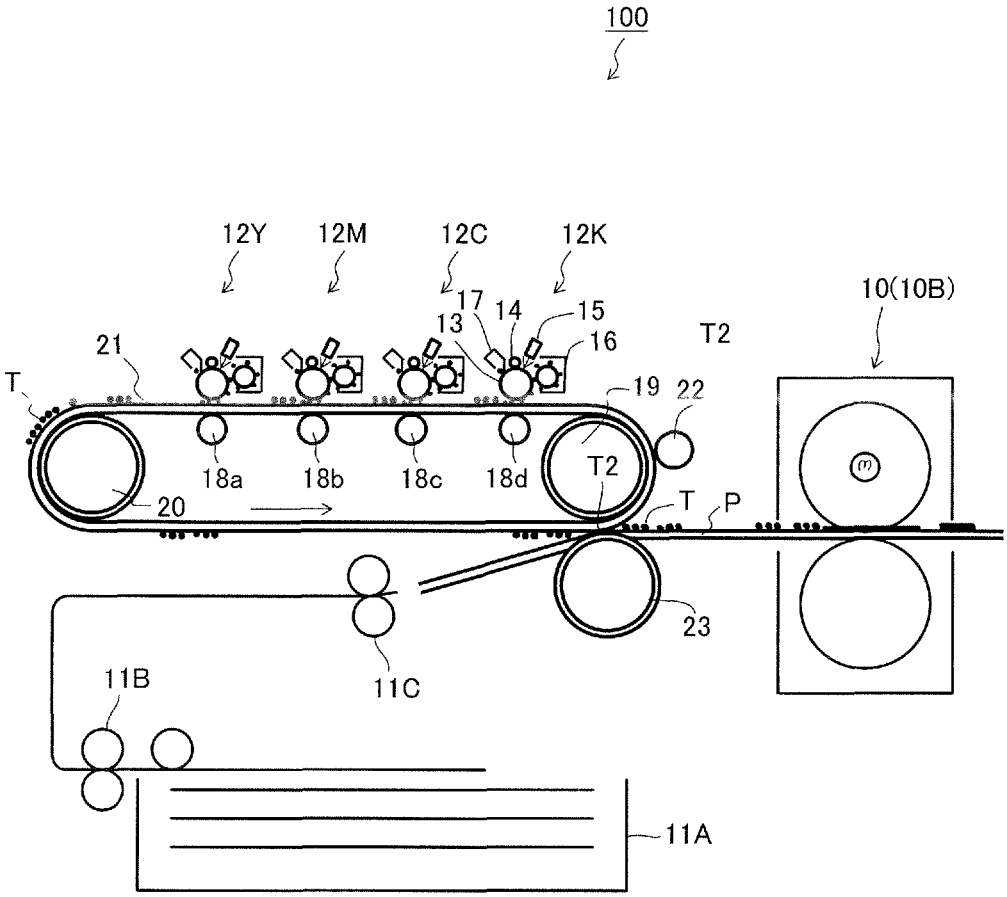
FIG. 1 is a schematic diagram illustrating a part of a configuration of an image forming apparatus.

FIG. 1 is a diagram schematically showing a part of a configuration of an image forming apparatus 100. As shown in FIG. 1, the image forming apparatus 100 is a tandem type intermediate transfer type full-color printer in which yellow, magenta, cyan, and black image forming portions 12Y, 12M, 12C, and 12K are arrayed along an intermediate transfer belt 21.

In the image forming portion 12Y, a yellow toner image is formed on a photoconductive drum 13 and is transferred to the intermediate transfer belt 21. In the image forming portion 12M, a magenta toner image is formed on a photoconductive drum 13 and is transferred to the intermediate transfer belt 21. In the image forming portions 12C and 12K, cyan and black toner images are formed respectively on photoconductive drums 13, 13 and are transferred to the intermediate transfer belt 21.

The four color toner images carried on the intermediate transfer belt 21 are conveyed to a secondary transfer portion T2 and are secondarily transferred altogether on a recording medium P. The recording medium taken out of a recording medium cassette 11A is separated one by one by a separation roller 11B and is conveyed to a registration roller 11C. The registration roller 11C feeds the recording medium P to the secondary transfer portion T2 by adjusting a feed timing with the toner image on the intermediate transfer belt 21.

A secondary transfer roller 23 forms the secondary transfer portion T2 by being into contact with the intermediate transfer belt 21, which is wrapped around a drive roller 19 that functions also as an intra-secondary transfer roller. A fixing apparatus 10 is configured to fix an image on the recording medium P by heating and pressing the recording medium P. The recording medium P, which has passed through the secondary transfer portion T2 and on which the toner image has been secondarily transferred, separates by itself from the intermediate transfer belt 21 and is sent to the fixing apparatus 10. The recording medium P on which the image has been fixed by the fixing apparatus 10 is then discharged out of the apparatus.

(Image Forming Portion)

The image forming portions 12Y, 12M, 12C, and 12K are constructed substantially in the same manner except that the colors of the toners used in respective developing units are different as yellow, magenta, cyan, and black. Therefore, only a toner image forming process of black image forming portion 12K will be explained below, and an overlapped explanation of the other image forming portions 12Y, 12M, and 12C will be omitted here.

The image forming portion 12K is provided with a charging roller 14, an exposure unit 15, a developing unit 16, a primary transfer roller 18*d*, and a drum cleaning unit 17 around the photoconductive drum 13. The photoconductive drum 13 has a photoconductive layer on a surface thereof and rotates at a predetermined processing speed. The charging roller 14 charges the surface of the photoconductive drum 13 with a homogeneous potential. The exposure unit 15 scans a laser beam by a rotary mirror to write an electrostatic image of an image on the surface of the photoconductive drum 13.

The developing unit 16 moves the toner to the photoconductive drum 13 to develop the electrostatic image as a toner image. By being applied with a voltage, the primary transfer roller 18*d* transfers the toner image carried on the photoconductive drum 13 to the intermediate transfer belt 21. The drum cleaning unit 17 rubs the photoconductive drum 13 by a cleaning blade to recover transfer residual toner left on the photoconductive drum 13.

The intermediate transfer belt 21 is wrapped around and supported by the drive roller 19, a tension roller 20 and primary transfer rollers 18*a*, 18*b*, 18*c* and 18*d*, and is driven by the drive roller 19 and rotates in a direction of an arrow in FIG. 1. A belt cleaning unit 22 recovers transfer residual toner on the intermediate transfer belt 21 passing through the secondary transfer portion T2. The secondary transfer roller 23 rotates by being driven by the intermediate transfer belt 21.

Figure 2:
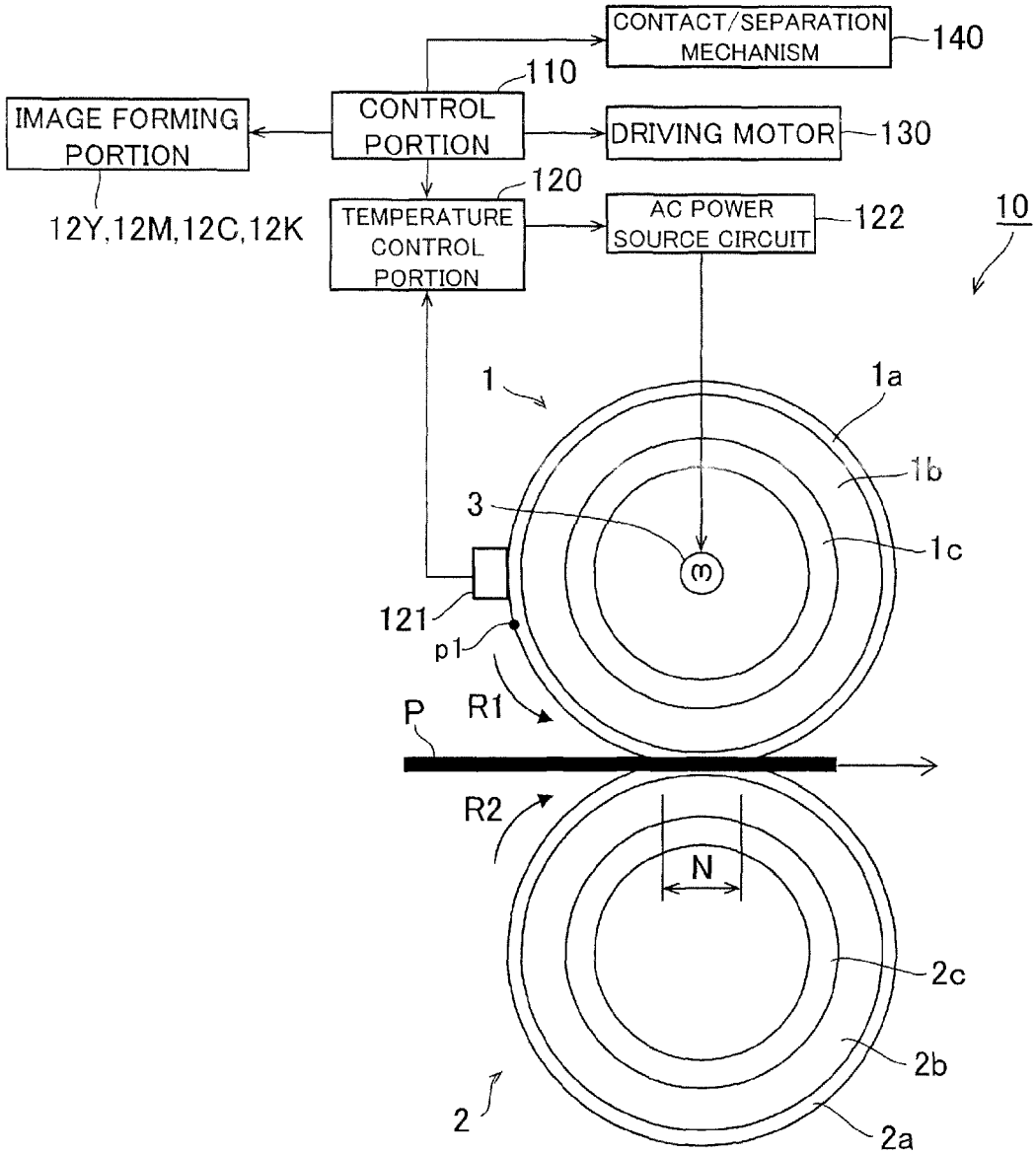
FIG. 2 is a diagram illustrating a configuration of a fixing apparatus of a first embodiment.

As shown in FIG. 2, a fixing roller 1, i.e., one exemplary heating member, of the fixing apparatus 10 is heated by a halogen lamp 3, i.e., one exemplary heat source. A pressure roller 2, i.e., one exemplary conveying member, comes into contact with the fixing roller 1 and forms a nip portion N where the recording medium is conveyed. A base layer 1*c* is heated by the halogen lamp 3. An elastic layer 1*b* is disposed on the base layer 1*c*, and a release layer 1*a* is disposed on the elastic layer 1*b*. Thermal permeability of the release layer 1*a* is greater than that of the elastic layer 1*b*.

A thickness d of the release layer 1*a* is expressed by the following equation, where α is thermal diffusivity of the release layer 1*a* and *t* is a stay time of the recording medium at the nip portion N. This equation will be detailed later.

$$\sqrt{\alpha t} \leq d \quad \text{Eq. 1}$$

In order to prevent toner offset by which toner moves to the fixing roller 1, a layer whose contact angle to melted toner on a surface of the release layer is greater than a contact angle to the melted toner on a surface of the elastic layer 1*b* at a same temperature is provided as the release layer 1*a*.

(Fixing Apparatus)

FIG. 2 is a diagram illustrating a configuration of the fixing apparatus 10 of the present embodiment. The fixing apparatus 10 is configured to heat and press the recording medium P on which the toner image has been transferred at the nip portion N where the fixing roller 1 is in contact with the pressure roller 2 to fix the image onto the recording medium P.

The fixing roller 1 is 300 mm in length and 30 mm in diameter. The fixing roller 1 is provided with the elastic layer 1*b* made of silicone rubber formed on the base layer 1*c* of a steel pipe of 1 mm thickness. The elastic layer 1*b* gives flexibility on a surface of the fixing roller 1 so that the fixing roller 1 can follow the unevenness of a surface of the recording medium. It is possible to adjust the length in a rotational direction of the nip portion N (nip width) and the image quality by adjusting the thickness and hardness of the elastic layer 1*b*. The surface of the elastic layer 1*b* is coated by the release layer 1*a* using a fluorine resin rubber material whose contact angle to the melted toner is greater than that of a silicone rubber. The release layer 1*a* exhibits releasability to the melted toner.

The pressure roller 2 is also 300 mm in length and 30 mm in diameter. The pressure roller 2 is provided with an elastic layer 2*b* made of silicone rubber 200 μm thick, formed on a base layer 2*c* of a steel pipe 1 mm thick. The elastic layer 2*b* gives flexibility on a surface of the pressure roller 2 to improve the state of contact of the fixing roller 1 with the surface of the recording medium. The surface of the elastic layer 2*b* is coated by a release layer 2*a* of a fluorine resin (PFA) 50 μm thick. The release layer 2*a* facilitates separation of the recording medium P.

By being driven by a driving motor 130, the fixing roller 1 rotates in a direction of an arrow R1. The pressure roller 2 can be brought into contact with and separated from the fixing roller 1 by a contact/separation mechanism 140. The pressure roller 2 is pressed toward the fixing roller 1 by the contact/separation mechanism 140 and forms a nip portion by being in contact with the fixing roller 1.

The pressure roller 2 rotates in a direction of an arrow R2 by being driven by the driving motor 130 during the time when the pressure roller 2 is separated from the fixing roller 1. When the pressure roller 2 is in pressure contact with the fixing roller 1, the pressure roller 2 is separated from the drive of the driving motor 130 by a one-way clutch (not shown) and rotates by being driven by the rotation of the fixing roller 1.

The halogen lamp 3 is disposed on a center axis of the fixing roller 1 and heats the base layer 1*c* of the fixing roller 1 from inside thereof. The length of a light emitting portion of the halogen lamp 3 is 324 mm. A temperature control portion 120 controls an AC power circuit (not shown) to feed power to the halogen lamp 3 such that the halogen lamp 3 generates radiant heat. The radiant heat of the halogen lamp 3 heats the base layer 1*c* of the fixing roller 1 and increases the temperature of the fixing roller 1.

A temperature sensor 121 detects the outer surface temperature of the fixing roller 1 at a position just before the nip portion N. Electrical information concerning the temperature outputted from the temperature sensor 121 is inputted to the temperature control portion 120. The temperature control portion 120 controls the output of the AC power circuit and regulates the power supplied to the halogen lamp 3 such that the temperature detected by the temperature sensor 121 maintains a target temperature (fixing temperature) in temperature control. Thus, the temperature of the surface of the fixing roller 1 rises to the fixing temperature set in advance and is kept at the fixing temperature.

(Explanation of Parameters of Heating Roller)

FIGS. 3A and 3B are graphs illustrating the changes of a temperature distribution in the diameter direction at the nip portion. Here, a heat transfer phenomenon at the nip portion between the heating member and the conveying member will be described and various parameters to be used will be explained by using relational expressions of heat transfer engineering shown in "Heat Transfer Engineering" written by Toshio Aihara, Shokabo Publishing Co., Ltd., pp. 31 through 35.

Here, changes of the temperature distribution in the diameter direction of the fixing roller 1 of a point p1 in a process in which the point p1 on the fixing roller 1 enters and passes through the nip portion N as shown in FIG. 2 will be studied. While the point p1 on the fixing roller 1 drops its temperature by passing through the nip portion N, the point p1 receives heat supplied from the halogen lamp 3 while it turns substantially one round and restores its temperature to the target temperature in the temperature control. The point p1 enters the nip portion N again, and its heat is taken away by the recording medium P.

As shown in FIG. 3A, the temperature of the point p1 drops to Tb at a moment when the point p1 on the fixing roller 1 enters the nip portion N and contacts with the recording medium P at time t=0. After that, as the point p1 moves within the nip portion N and time elapses as t1, t2 and t3, the temperature distribution of the recording medium P and the fixing roller 1 is gradually smoothed. Here, the recording medium P and the fixing roller 1 are assumed to be semi-infinite solids. Although the recording medium P and the fixing roller 1 are not semi-infinite solids, they may be regarded as semi-infinite solids because a time during which the point p1 of the fixing roller 1 stays at the nip portion N is short and a range affected by heat during the stay is limited to a superficial area thereof.

As shown in FIG. 3B, non-stationary heat conduction occurs within the fixing roller 1, and the temperature changes every moment. While an interfacial temperature between the fixing roller 1 and the recording medium P at the point p1 is constant at the temperature Tb, the average temperature of the fixing roller 1 side gradually drops as the temperature distribution becomes smooth, so that a heat flow rate from the fixing roller 1 to the recording medium P decreases. If the average temperature is too low, there is a possibility that the heat capacity of the fixing roller 1 heating the recording medium P becomes insufficient and the toner image is insufficiently melted and fixed.

The temperature distribution within the fixing roller 1 is a function of the time t from the contact and the position x in the depth direction. The position x is a coordinate system with an origin located at a contact interface between the fixing roller 1 and the toner image. The non-stationary changes of the temperature within the fixing roller 1 can be found by the following equation by solving a non-stationary heat conduction equation by setting a condition in which the interfacial temperature of the fixing roller 1 whose initial temperature has been Th is fixed to Tb as a boundary condition:

$$T_h(t, x) = T_h - (T_h - T_b)\mathrm{erfc}\left(\frac{x}{2\sqrt{\alpha_h t}}\right) \quad \text{Eq. 2}$$

$$\begin{aligned} x = 2\sqrt{\alpha_h t} \Rightarrow T_h(t, x) &= T_h - (T_h - T_b)\mathrm{erfc}(1) \\ &= T_h - (T_h - T_b)0.16 \end{aligned} \quad \text{Eq. 3}$$

Here, "erfc" in Equation 2 denotes a complementary error function, and $\alpha_h$[m$^2$/sec] denotes the thermal diffusivity of an outer surface layer of the fixing roller 1. x in Equation 3 represents the depth from the contact interface where the temperature $T_h$ of the fixing roller 1 changes by 16% to the boundary temperature $T_b$ in the contact time t. This depth of permeation of the change of the temperature distribution will be referred to as the thermal diffusive length L. This is used in the field of the heat conduction engineering in general as an index of the range of influence of temperature when the non-stationary heat conduction occurs.

$$L = 2\sqrt{\alpha t} \quad \text{Eq. 4}$$

A heat flux q[W/m$^2$] flowing from the fixing roller into the recording medium P by the non-stationary heat conduction expressed by Equation 2 can be obtained as follows:

$$q = \frac{b_h}{\sqrt{\pi t}}(T_h - T_b)$$

$$b_h = \sqrt{\lambda_h \rho C_h}$$

where, $b_h$[J/(m$^2$·K·s$^{0.5}$)] is thermal permeability of the outer release layer of the fixing roller, $\lambda_h$[W/(m·K)] is thermal conductivity of the surface layer of the fixing roller, and $\rho C_h$[J/(m$^3$·K)] is heat capacity of the release layer of the fixing roller. . . . Eq. 5

As it is apparent from Equation 5, the greater the thermal permeability $b_h$ of the outer surface layer of fixing roller, the more readily the fixing roller 1 can apply thermal energy to the recording medium P. As a result, it is possible to melt and fix the toner efficiently. Still further, because there is a positive correlation between the quantity of heat applied to the recording medium P and the fixability of the toner, it is possible to lower the temperature of the fixing roller 1 while maintaining the toner fixability by using a material having large thermal permeability $b_h$ for the surface layer of the fixing roller 1.

As described above, the thermal diffusive length L serves as an index indicating the range of influence of temperature when the non-stationary heat conduction occurs and the thermal permeability $b_h$ serves as an index indicating capacity of a substance giving and taking energy.

(Study on Influence of Thickness)

Figure 4:
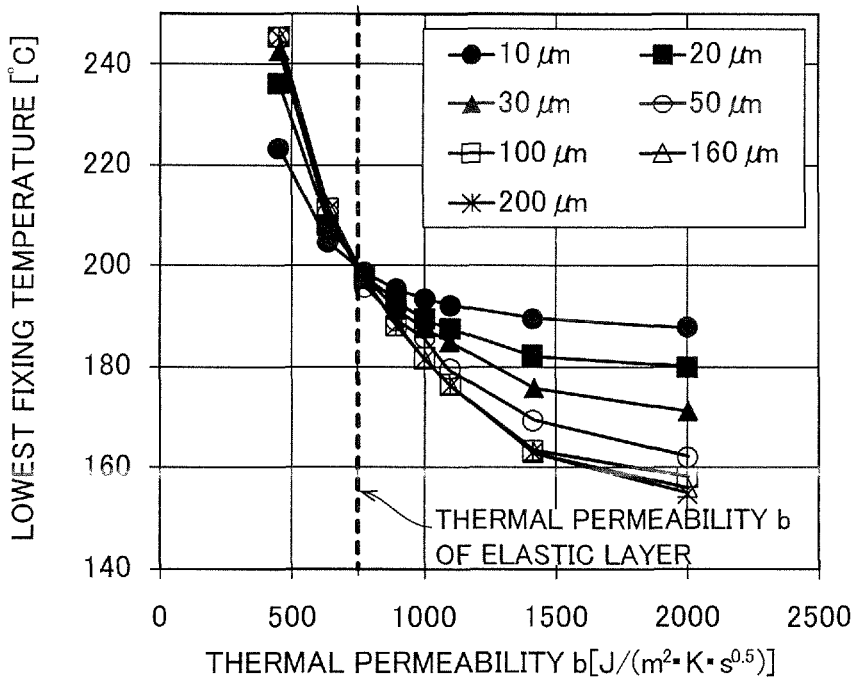
FIG. 4 is a graph indicating the results of study implemented on thicknesses of a release layer.

FIG. 4 is a graph indicating results of study implemented on a thicknesses of the release layer.

As shown in Table 1, the influence of the thermal permeability b on the lowest toner fixing temperature was studied by studying the toner fixability by varying the thickness d and the thermal permeability b (thermal conductivity $\lambda_h$ here) of the release layer 1*a* of the fixing roller 1 to study a fixing condition effective for lowering the target temperature in the temperature control of the fixing roller 1.

TABLE 1

| | THICKNESS d [μm] | THERMAL CONDUCTIVITY λ [W/(m · K)] | HEAT CAPACITY ρC [J/(m$^3$ · K)] | THERMAL PERMEABILITY b [J/(m$^2$ · K·s$^{0.5}$)] |
|---|---|---|---|---|
| ELASTIC LAYER | 200 | 0.3 | $1.86 \times 10^6$ | 747 |
| RELEASE LAYER | 10~200 | 0.1~2.0 | $2.0 \times 10^6$ | 447~2000 |

The lowest toner fixing temperature is the smallest outer surface temperature of the fixing roller 1 just before the nip portion that is required to exceed 90% of toner residual ratio on the recording medium after a destruction test carried out by applying a predetermined amount of bending and friction on a fixed image.

As described in "Basics and Application of Electrophotographic Technology" 1988, Corona Publishing Co., Ltd., pp. 192 to 210, the toner fixability is correlated with fixing strength expressed by a function of a pressing force, a nip portion passing time, and toner viscosity at the nip portion. On a basis of such correlation, the toner fixability was evaluated and the lowest fixing temperature in each fixing condition was found by estimating the toner temperature (viscosity) at the nip portion N from simulations of a heat conduction reflecting the fixing conditions.

As shown in FIG. 4, the greater the thermal permeability b of the release layer, the lower the lowest fixing temperature can be. The abscissa axis in FIG. 4 represents the thermal permeability b of the release layer 1*a* of the fixing roller 1 and the ordinate axis represents the lowest toner fixing temperature. This happens because the greater the thermal permeability b, the more efficiently the thermal energy is applied to the toner.

When the fixing conditions are compared in terms of the thickness d of the release layer, a tendency of the thickness d of the release layer advantageous for lowering the lowest fixing temperature is switched about the thermal permeability b of the elastic layer (broken line in FIG. 4) and there exists a clear threshold value. That is, it is advantageous for lowering the lowest fixing temperature when the thickness d of the release layer is thin in a range in which the thermal permeability b of the elastic layer is greater than the thermal permeability b of the release layer. Conversely, it is advantageous for lowering the lowest fixing temperature when the thickness d of the release layer is thick in a range in which the thermal permeability b of the elastic layer is smaller than the thermal permeability b of the release layer.

(Study on Influence of Thermal Diffusion Length)

Figure 6:
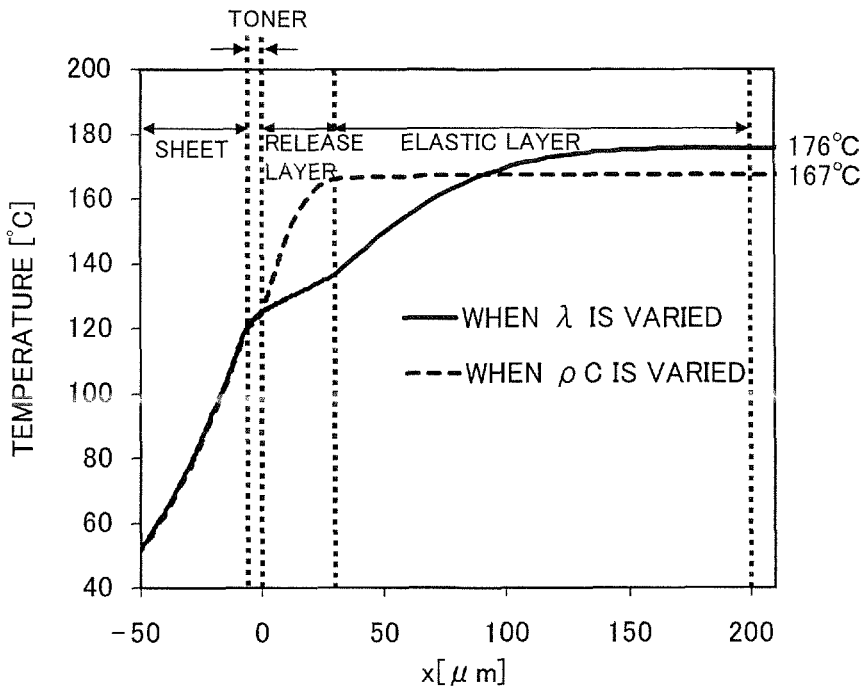
FIG. 6 is a graph illustrating a temperature distribution in a depth direction in the case where the thickness of the release layer is 30 μm.

FIGS. 5A and 5B are graphs illustrating the results of a study on the thermal diffusion length of the release layer, and FIG. 6 is a graph illustrating the temperature distribution in the depth direction in a case where the thickness of the release layer is 30 μm.

As shown in Table 2, the toner fixability was studied by varying the thermal conductivity λ and the heat capacity ρC of the release layer 1*a* of the fixing roller 1 in cases where the thickness of the release layer 1*a* was 30 μm and 200 μm to study the influence of the thermal diffusion length L on the lowest toner fixing temperature and a fixing condition effective for lowering the target temperature in the temperature control of the fixing roller 1.

TABLE 2

| | THICKNESS d [μm] | THERMAL CONDUCTIVITY λ [W/(m · K)] | HEAT CAPACITY ρC [J/(m$^3$ · K)] | THERMAL PERMEABILITY b [J/(m$^2$ · K · s$^{0.5}$)] |
|---|---|---|---|---|
| ELASTIC LAYER | 200 | 0.3 | $1.86 \times 10^6$ | 747 |
| RELEASE LAYER | 30, 200 | 0.1 | $2.0 \times 10^6$~$40 \times 10^6$ | 447~2000 |

As shown in FIG. 5B, in the case where the thickness d of the release layer 1*a* is 200 μm, the greater the thermal permeability b of the release layer, the lower the lowest fixing temperature becomes. The lowest fixing temperature is equal even in a case where the thermal conductivity λ is increased or the heat capacity ρC is increased to increase the thermal permeability b of the release layer. Even if the thermal conductivity λ is increased in the case where the release layer 1*a* is thick, it does not affect the thermal permeability b of the elastic layer 1*b*, so that the effect of the increase of the thermal permeability b of the release layer 1*a* appears significantly and the lowest fixing temperature can be fully lowered.

In the case where the thickness d of the release layer 1*a* is 30 μm as shown in FIG. 5A, the greater the thermal permeability b of the release layer, the lower the lowest fixing temperature becomes. In a case where the thermal conductivity λ, is increased to increase the thermal permeability b of the release layer 1*a*, the lowest fixing temperature rises as compared to a case where the heat capacity ρC is increased. In the case where the release layer 1*a* is thin, the influence of the thermal permeability b of the elastic layer 1*b* becomes significant when the thermal conductivity λ is increased, so that the effect of the increase of the thermal permeability b of the release layer is lessened and the lowest fixing temperature cannot be fully lowered.

As shown in FIG. 6, when the thickness d of the release layer 1*a* is 30 μm and the thermal permeability b is 1400 [J/m$^2$·K·sec$^{0.5}$]], a temperature distribution appears as indicated by a solid line in the case where the thermal conductivity λ is increased and a temperature distribution appears as indicated by a broken line in the case where the heat capacity ρC is increased. Because the time t passing through the nip portion N is 10 msec, a temperature distribution in the depth x direction at the moment when the surface of the fixing roller 1 is cooled by 10 msec is compared. The fixability of the toner image is equal in the both cases where the thermal conductivity λ is increased and the heat capacity ρC is increased because the temperature distribution on the recording medium side is equal.

However, on the fixing roller 1 side, the temperature distribution differs considerably in the cases where the heat capacity ρC is increased (broken line) and the thermal conductivity λ is increased (solid line). In the case where the heat capacity ρC is increased, because the thermal diffusion length L is 30 μm, a depth influenced by the cooling during 10 msec in which the fixing roller 1 passes through the nip portion N is kept substantially within 30 μm of the thickness of the release layer 1*a*. However, in the case where the thermal conductivity λ is increased, because the thermal diffusion length L is 150 μm, the depth influenced by the cooling during 10 msec in which the fixing roller 1 passes through the nip portion N affects the elastic layer 1*b* beyond the release layer 1*a*.

(Problem of Power Consumption)

As shown in FIG. 6, in a case where the thermal conductivity λ is increased, the target temperature of the temperature control of the fixing roller 1 necessary to obtain the equal fixability is 176° C. and is higher than 167° C. in the cases where the heat capacity ρC is increased and the thickness of the release layer 1*a* is 200 μm. That is, in order to equally assure the fixability of the same output image, the outer surface temperature of the fixing roller 1 must be kept high when the thickness of the release layer 1*a* is 30 μm as compared to the case when the thickness of the release layer 1*a* is 200 μm. If the outer surface temperature of the fixing roller 1 is kept high, radiation of heat of the fixing roller 1 is intensified, so that the power consumption increases. Thermal deterioration of the respective layers of the fixing roller 1 also accelerates if the outer surface temperature of the fixing roller 1 is kept high.

(Lower Limit Value of Thickness of Release Layer)

FIGS. 7A and 7B are graphs illustrating the relationship between the thickness of the release layer and the lowest fixing temperature.

As shown in Table 3, the nip portion passing time t and the thickness of the release layer 1*a* were varied to evaluate the fixability of the output image as described above and to study their lowest fixing temperature. On a basis of experimental results, a relationship among the lowest fixing temperature, thermal diffusion length L, the thickness d of the release layer 1*a*, and the nip portion N passing time t was generalized.

TABLE 3

| NIP TIME [msec] 10~100 | | | | |
|---|---|---|---|---|
| | THICKNESS d [μm] | THERMAL CONDUCTIVITY λ [W/(m · K)] | HEAT CAPACITY ρC [J/(m$^3$ · K)] | THERMAL PERMEABILITY b [J/(m$^2$ · K · s$^{0.5}$)] |
| ELASTIC LAYER | 200 | 0.3 | $1.86 \times 10^6$ | 747 |
| RELEASE LAYER | 10~200 | 0.6 | $2.0 \times 10^6$ | 1095 |

As shown in FIG. 7A, the lowest fixing temperature saturates to a predetermined temperature around where the thickness of the release layer 1*a* exceeds the thermal diffusion length L in every nip portion passing time t. Then, the saturated predetermined temperature was subtracted from the data of the lowest fixing temperature regarding the respective nip portion passing times 10 to 100 msec to standardize and to express the data of all nip portion passing times t as one graph.

As shown in FIG. 7B, the tendency of the lowest fixing temperature can be consolidated by the thermal diffusion length L even when the nip portion passing time t is different. Still further, the lowest fixing temperature reaches a saturation temperature actually around where the thickness of the release layer 1*a* exceeds 50% of the thermal diffusion length L. Due to that, the heat transfer characteristic of the release layer 1*a* can be fully used by making the thickness d of the release layer 1*a* as expressed by the following equation in which the thickness d of the release layer 1*a* is 50% or more of the thermal diffusion length L, where $\alpha$ [$m^2$/sec] is the thermal diffusivity of the release layer 1*a* and *t* [sec] is the recording medium stay time in the nip portion N:

$$\sqrt{\alpha t} \leq d \qquad \text{Eq. 6}$$

Here, a case where the fixing roller 1 has a n layer structure will be generalized and expressed. That is, the fixing roller 1 is assumed to have a multi-layer structure of n layers in total in which the layers are denoted by layer numbers in order from 1 from the layer of the heat source side to the surface layer in contact with the recording medium. Then, a $n^{th}$ layer in $b_n > b_{n-1}$ is formed to have a thickness do expressed by the following equation, where $b_j$ is thermal permeability of a $j^{-th}$ (j=1 to n) layer, $\alpha_j$ is thermal diffusivity, $d_j$ is a thickness, and t is a recording medium stay time in the nip portion N.

$$\sqrt{\alpha_n t} \leq d_n \qquad \text{Eq. 7}$$

No matter how many layers the heating member includes, the exchange of the quantity of heat between the heating member and the recording medium at the nip portion N follows basically to Equation 2, and even if the number of layers is generalized into the n layer structure, the thickness of the release layer can be defined with the similar relationship as described in Equation 7.

Although there is a case where there is a primer layer as an adhesive layer between the layers, normally the primer layer is ignored as a layer because the primer layer is fully thin as compared to the elastic layer and the release layer. That is, the present invention which primarily considers the quantity of exchanged heat at the respective layers does not consider the primer layer as a layer number because the thermal contribution of the primer layer is small. Therefore, the primer layer is not considered as a layer hereinafter.

Still further, while, depending on a formation process of the elastic layer, there is a case where a skin layer having a different quantity of dispersed filler from that in a bulk of the elastic layer is formed on the surface or the interface with the elastic layer, the skin layer is ignored as a layer because a thickness of the skin layer is fully thin as compared to the thickness of the elastic layer. That is, the present invention which primarily considers the quantity of exchanged heat at the respective layers does not consider the skin layer as a layer number because the thermal contribution of the skin layer is small. Therefore, the skin layer is not also considered as a layer hereinafter.

(Upper Limit Value of Thickness of Releasing Layer)

Figure 8:
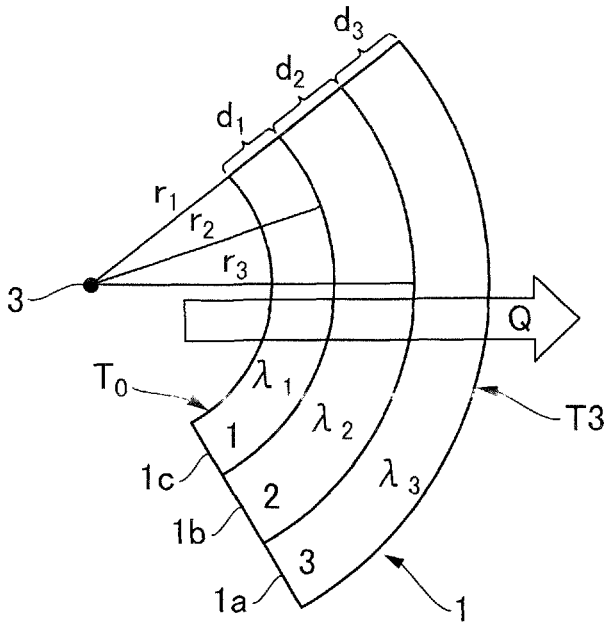
FIG. 8 is a diagram illustrating a parameter of each layer of a fixing roller.
Figure 9:
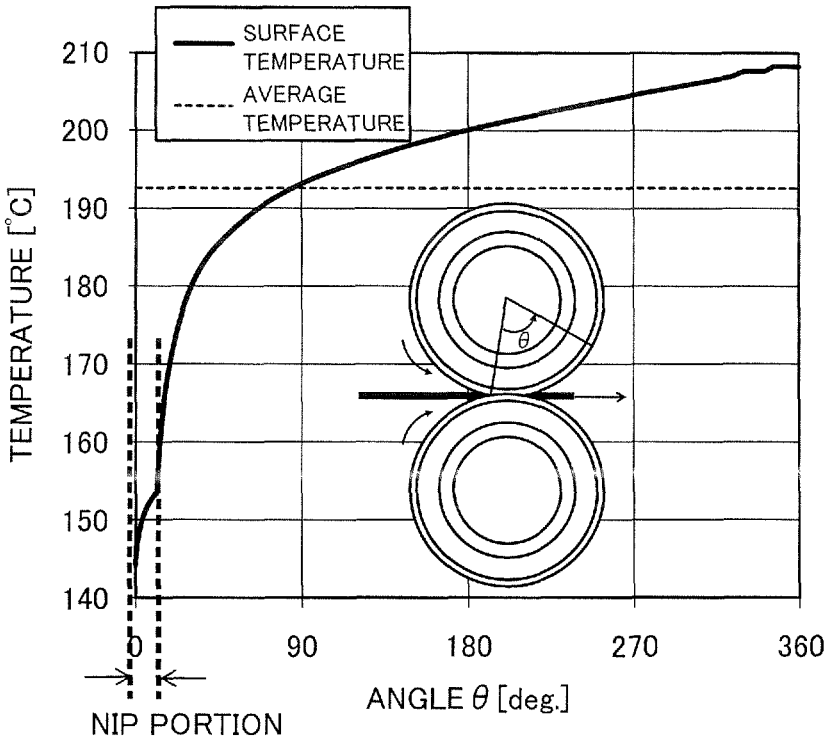
FIG. 9 is a graph illustrating changes of an outer surface temperature in one rotation of the fixing roller.
Figure 10:
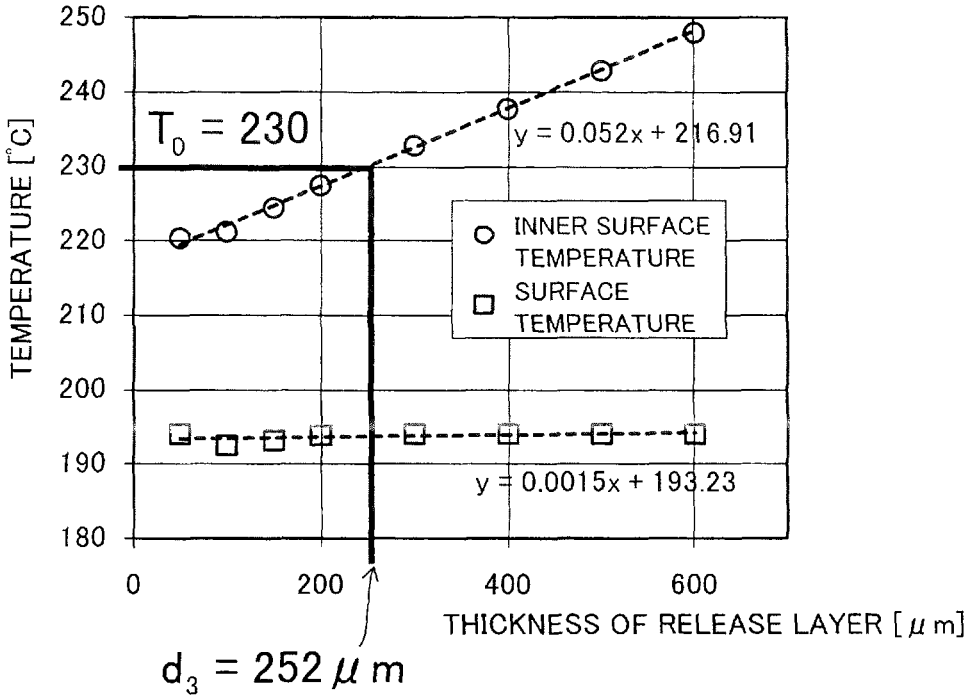
FIG. 10 is a graph illustrating an upper limit value of the thickness of the release layer.
Figure 11:
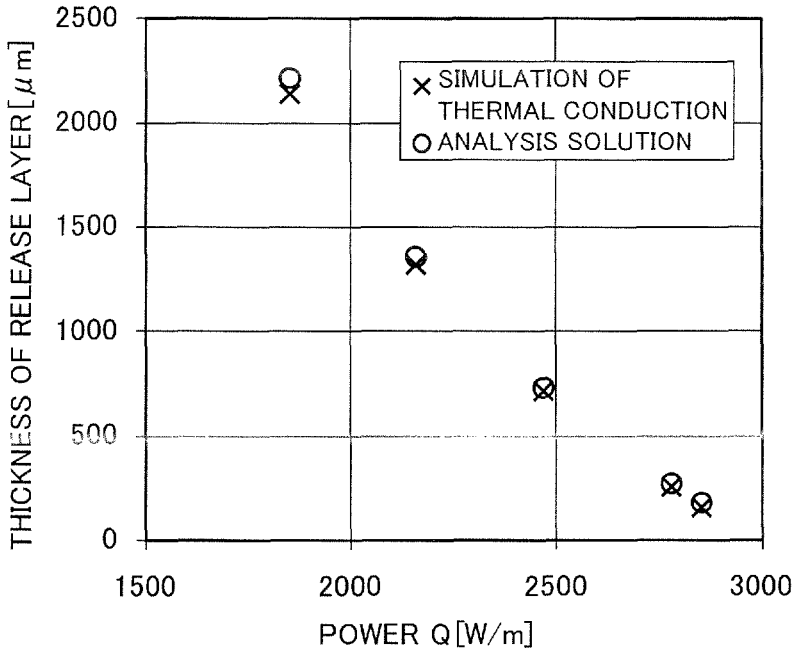
FIG. 11 is a graph illustrating a relationship between a supply power and a maximum allowable thickness of the release layer.

FIG. 8 is a diagram illustrating a parameter of each layer of the fixing roller 1, FIG. 9 is a graph illustrating changes of the outer surface temperature in one rotation of the fixing roller 1, FIG. 10 is a graph illustrating an upper limit value of the thickness of the release layer, and FIG. 11 is a graph illustrating a relationship between a supply power and the maximum allowable thickness of the release layer.

As shown in FIG. 8, the thickness $d_3$ of the release layer 1*a* should be designed on the basis of the relationship of Equation 4 in order to fully utilize the heat transfer characteristic of the release layer 1*a*. However, if the thickness of the release layer 1*a* is increased, the total heat resistance of the fixing roller 1 increases and there is a possibility that the temperature of the elastic layer 1*b* exceeds the heat resistant temperature. Then, it is necessary to define an upper limit value of the thickness $d_3$ of the release layer 1*a* so that the temperature of each layer of the fixing roller 1 does not exceed respective heat resistant temperature even in an operation state in which a quantity of heat of the halogen lamp 3 is maximized. A time when a temperature difference is maximized between temperatures of an inner circumferential surface and an outer circumference of the fixing roller 1 and when the temperature of the inner circumferential surface is high is a time when images are formed continuously by zeroing intervals between the images. Then, it is considered that no problem occurs under other fixing conditions if the thickness $d_3$ of the release layer 1*a* is set such that the temperature of each layer of the release layer 1*a* goes under the heat resistant temperature even in forming images continuously as described above.

As shown in FIG. 8, radiant energy of the halogen lamp 3 inputted from a center of the fixing roller 1 is transmitted radially from inside to outside of each layer of the fixing roller 1. The fixing roller 1 is composed of the base layer 1*c*, the elastic layer 1*b* and the release layer 1*a* from inside to outside. Numbers j will be assigned to the respective layers from the layer on the heat source side to the surface side coming into contact with a recording medium as j=1: the base layer 1*c*, j=2: the elastic layer 1*b*, and j=3: the release layer 1*a*. An inner diameter of each layer will be denoted as $r_j$ (j=1 to 3), a thickness as $d_j$ (j=1 to 3), and thermal conductivity as $\lambda_j$ (j=1 to 3). The temperature of an outer circumferential surface of each layer will be denoted as $T_j$ (j=1 to 3), and the temperature of an inner circumferential surface of an innermost layer will be denoted as $T_0$. The length in a sheet depth direction of the fixing roller 1 will be denoted as 1[m], and the electric power (referred to simply as a "power" hereinafter) per unit length radiated from the halogen lamp 3 will be denoted as Q [W/m]. This state can be modeled as a steady heat transfer phenomenon of a cylindrical material.

When the power Q [W/m] is applied from the center of the cylindrical fixing roller 1, a relationship expressed by Equation 8 holds between the temperature $T_0$ of the inner circumferential surface of the innermost layer and the temperature $d_3$ of the outer circumferential surface in contact with the recording medium P. It is possible to obtain Equation 9 by solving Equation 8 as to the thickness $d_3$ of the release layer 1*a*.

$$Q = \frac{2\pi}{\frac{1}{\lambda_1}\ln\frac{r_2}{r_1} + \frac{1}{\lambda_2}\ln\frac{r_3}{r_2} + \frac{1}{\lambda_3}\ln\frac{r_3 + d_3}{r_3}}(T_0 - T_3)$$

where, $r_{1\sim3}$[m] are inner diameters of base, elastic and release layers, $d_{1\sim3}$[m] are thicknesses of base, elastic and release layers, $\lambda_{1\sim3}$[W/(m·K)] are thermal conductivities of base, elastic and release layers, $T_{1\sim3}$[° C.] are temperatures of outer circumferential surfaces of base, elastic and release layers, and $T_0$[° C.] is temperature of the inner circumferential surface of the base layer. . . . Eq. 8

$$d_3 = r_3\left[\exp\left\{\lambda_3\left[\frac{2\pi}{Q}(T_0 - T_3) - \frac{1}{\lambda_1}\ln\frac{r_2}{r_1} - \frac{1}{\lambda_2}\ln\frac{r_3}{r_2}\right]\right\} - 1\right] \quad \text{Eq. 9}$$

The temperature $T_0$ of the inner circumferential surface of the innermost layer is highest in the fixing roller 1 because the inner circumferential surface is closest to the halogen lump 3, i.e., the heat source. Therefore, it is possible to eliminate the problem of the heat resistance of the fixing roller 1 by designing the thickness of the release layer 1*a* to be less than a thickness which makes the temperature $T_0$ of the inner circumferential surface of the fixing roller 1 lower than a heat resistant limit temperature on a basis of Equation 9.

By the way, because the second layer, i.e., the elastic layer 1*b*, is examined in terms of the heat resistance in the case where the first layer is the metallic base layer 1*c*, it is necessary to design the thickness of the release layer 1*a* such that the temperature $T_1$ of the elastic layer 1*b* is lower than the heat resistant limit temperature of the elastic layer 1*b*. However, because the thermal conductivity of metal is very large and there is barely no temperature distribution within the metallic layer, i.e., substantially, $T_1 \approx T_0$, the thickness of the release layer 1*a* should be designed such that the temperature $T_0$ is lower than the heat resistant limit temperature of the elastic layer 1*b*.

It is also possible to design in the same manner even when a layer structure is changed by adding a layer by applying Equation 9.

Here, a case where the fixing roller 1 is composed of n layers will be generalized and expressed. That is, the fixing roller 1 is assumed to have a multi-layer structure of n layers in total in which layer No. is assigned to each layer in order from 1 to the layer on the heat source side to the surface layer in contact with the recording medium. A thickness of a $n^{-th}$ layer is set as expressed by the following equation, where $r_j$ is an inner diameter of a $j^{-th}$ (j=1 to n) layer, $d_j$ is a thickness thereof, $\lambda_j$ is thermal conductivity, $T_j$ is a temperature of an outer circumferential surface of the $j^{-th}$ layer, and $T_0$ is a temperature of an inner circumferential surface of the first layer:

$$d_n = r_n\left[\exp\left\{\lambda_n\left[\frac{2\pi}{Q}(T_0 - T_n) - \sum_{j=1}^{n-1}\frac{1}{\lambda_j}\ln\frac{r_{j+1}}{r_j}\right]\right\} - 1\right]$$

where, $r_j$[m] is an inner diameter of a $j^{-th}$ layer, $d_j$[m] is a thickness of the $j^{-th}$ layer, $\lambda_j$[W/(m·K)] is thermal conductivity of the $j^{-th}$ layer, $T_j$[° C.] is a temperature of an outer circumferential surface of the $j^{-th}$ layer, and $T_0$[° C.] is a temperature of an inner circumferential surface of the $j^{-th}$ layer. . . . Eq. 10

As shown in Table 4, regarding the fixing apparatus 10 shown in FIG. 2, the temperature $T_0$ of the inner circumferential surface of the fixing roller 1 was evaluated by setting the thickness and thermal physical properties of each layer of the fixing roller 1 and by carrying out a heat conduction simulation by modeling the fixing roller 1 by a two-dimensional section. That is, the relationship between thicknesses $d_1$, $d_2$ and $d_3$ of the respective layers of the fixing roller 1 and the temperature $T_0$ of the inner circumferential surface of the fixing roller 1 by varying the thickness of the release layer 1*a* of the fixing roller 1 was studied.

TABLE 4

| | | THICKNESS d [μm] | THERMAL CONDUCTIVITY λ [W/(m · K)] | HEAT CAPACITY ρC [J/(m³ · K)] | THERMAL PERMEABILITY b [J/(m² · K · s^0.5)] |
|---|---|---|---|---|---|
| FIXING ROLLER | BASE LAYER | 1000 | 90 | $4.0 \times 10^6$ | 18974 |
| | ELASTIC LAYER | 200 | 0.3 | $1.86 \times 10^6$ | 747 |
| | RELEASE LAYER | 50~600 | 0.6 | $2.0 \times 10^6$ | 1095 |
| TONER | TONER | 5 | 0.3 | $1.8 \times 10^6$ | 735 |
| IMAGE | PAPER | 115 | 0.12 | $1.2 \times 10^6$ | 379 |
| PRESSURE ROLLER | RELEASE LAYER | 50 | 0.2 | $2.3 \times 10^6$ | 678 |
| | ELASTIC LAYER | 200 | 0.3 | $1.86 \times 10^6$ | 747 |
| | METALLIC BASE LAYER | 1000 | 90 | $4.0 \times 10^6$ | 18974 |

As shown in a graph in FIG. 9, changes of the outer surface temperature of one rotation of the fixing roller 1 in a stationary state was simulated when a power Q=2778[W/m] and the thickness $d_3$ of the release layer 1*a*=50 μm. The stationary state is a state in which a continuous sheet (image interval=0) is fixed until when the changes of the outer surface temperature of one rotation of the fixing roller 1 are constantly repeated. The abscissa axis of the graph represents a rotational angle from a position where a recording medium starts to enter the nip portion N, and the ordinate axis represents a temperature at one point on the surface of the fixing roller 1.

While Equation 9 describes a state in which the steady heat conduction phenomenon is generated isotropically in the rotational direction strictly in a cylindrical system as shown in FIG. 8, actually the fixing roller 1 repeats cycles of cooling and re-heating of the outer surface temperature as shown in FIG. 9. Then, an outer surface temperature $T_3$ was taken as an average value of the outer surface temperature here:

$$T_3 = \hat{T}_3(\text{outer surface average temperature})$$

where, $\hat{T}_3$ is an average value of outer surface temperatures $T_3$, and $\hat{T}_0$ is an average value of an inner surface temperature of fixing roller. . . . Eq. 11

Here, the halogen lamp 3 heats the whole in the rotational direction of the fixing roller 1 homogeneously. An operation condition is set such that the average temperature of the inner circumferential surface of the fixing roller 1 is less than the heat resistant temperature of a $n-1^{th}$ layer of the fixing roller 1. At this time, the temperature $T_0$ of the inner surface of the fixing roller 1 is substantially at a constant value of 220° C. around the fixing roller 1 because the thermal conductivity of metal is large, and is substantially equal to the average value of the temperatures $T_0$ of the inner surface of the fixing roller 1. Then, a simulation of heat conduction of the average values of the inner surface and the surface of the fixing roller 1 was carried out by varying the thickness d of the release layer 1*a* from 50 to 600 μm in this state as shown in FIG. 10.

As shown in FIG. 10, the average temperatures of the inner surface and the surface of the fixing roller 1 have both linear relationships with the thickness d ($d_3$) of the release layer 1*a*. Accordingly, the thickness d ($d_3$) of the release layer 1*a* must be less than 252 μm if the heat resistant temperature of the rubber of the elastic layer 1*b* is assumed to be 230° C.

Next, a study on a similar heat conduction simulation was carried out under conditions of other ordinary power Q and a maximum allowable thickness (marks x) of the release layer 1*a* for keeping the temperature $T_0$ of the inner circumferential surface of the fixing roller 1 below 230° C. was found as shown in FIG. 11.

As shown in FIG. 11, it was found that results of the heat conduction simulation (marks x in FIG. 11) of the heat conduction coincide very well with analytical solutions (mark o in FIG. 11) obtained on a basis of Equation 4 described above. Accordingly, even if the outer surface temperatures of the fixing roller 1 are inhomogeneous, it is possible to estimate the thickness of the release layer 1*a* by Equation 9 by using an average value of the outer surface temperatures as a thermal typical value.

Then, it is possible to keep the temperature of the inner circumferential surface below the heat resistant limit temperature of the fixing roller 1 while fully utilizing the heat transfer characteristic of the release layer 1*a* by defining the thickness $d_3$ of the release layer 1*a* of the fixing roller 1 as described by the following Equation 12 in which Equations 6 and 9 are combined:

$$\sqrt{\alpha_3 t} < d_3 < r_3\left[\exp\left\{\lambda_3\left[\frac{2\pi}{Q}(\hat{T}_0 - \hat{T}_3) - \sum_{j=1}^{2}\frac{1}{\lambda_j}\ln\frac{r_{j+1}}{r_j}\right]\right\} - 1\right] \quad \text{Eq. 12}$$

When the case where the fixing roller 1 is composed of n-layers is generalized, it may be expressed as the following Equation 13 by combining Equation 7 with Equation 10. It is possible to keep the temperature of the inner circumferential surface below the heat resistant limit temperature of the second layer of the fixing roller 1 while fully utilizing the heat transfer characteristic of the $n^{-th}$ layer by defining the thickness $d_n$ of the $n^{-th}$ layer of the fixing roller 1 as described by the following Equation 13:

$$\sqrt{\alpha_n t} < d_n < r_n\left[\exp\left\{\lambda_n\left[\frac{2\pi}{Q}(\hat{T}_0 - \hat{T}_n) - \sum_{j=1}^{n-1}\frac{1}{\lambda_j}\ln\frac{r_{j+1}}{r_j}\right]\right\} - 1\right] \quad \text{Eq. 13}$$

(Specific Configuration of First Embodiment)

As shown in FIG. 2, the fixing roller 1 has 300 mm in length and 30 mm in diameter. The elastic layer 1*b* made of silicone rubber having 200 μm in thickness is formed on the base layer 1*c* made of iron having 1 mm in thickness in the fixing roller 1. The elastic layer 1*b* gives flexibility to the fixing roller 1 to regulate the width in the conveying direction of the nip portion N and image quality of an output image by adjusting the thickness and hardness thereof. The elastic modulus of the elastic layer 1*b* disposed right under the release layer 1*a* of the fixing roller 1 is smaller than that of the release layer 1*a*, and a contact angle to melted toner of the surface of the release layer 1*a* is larger than that of the surface of the elastic layer 1*b* at a same temperature. The elastic modulus of the $n-1^{-th}$ layer is smaller than that of the $n^{th}$ layer, and a contact angle to melted toner of the surface of the $n-1^{-th}$ layer is smaller than that of the surface of the $n^{th}$ layer at the same temperature.

The surface of the elastic layer 1*b* is coated by the release layer 1*a* made of fluoro-rubber having a thickness of 100 μm. Because high thermal conductive inorganic filler is doped in the release layer 1*a*, so that thermal conductivity of the fluoro-rubber material is enhanced. The high thermal conductive inorganic filler is blended in the release layer 1*a* of the fixing roller 1 to enhance both the heat capacity and the thermal conductivity per unit volume of the release layer 1*a*.

The pressure roller 2 is also 300 mm in length and 30 mm in diameter. The elastic layer 2*b* made of silicone rubber having a thickness of 200 μm is formed on the base layer 2*c* made of iron having a thickness of 1 mm. The elastic layer 2*b* is coated by the release layer 2*a* made of fluoro-resin (PFA) having a thickness of 50 μm. Table 5 shows heat physical property values of the respective layers of the fixing roller 1 and the pressure roller 2.

The density of each layer was measured by means of an immersion method by using a density meter. A specific heat was measured by using a differential scanning calorimeter (DSC), and the heat capacity was found from a product of the density and the specific heat. The thermal conductivity was measured by using ai-Phase Mobile 2 (ai-Phase Co., Ltd.).

TABLE 5

| | | THICKNESS d [μm] | THERMAL CONDUCTIVITY λ [W/(m · K)] | HEAT CAPACITY ρC [J/(m³ · K)] | THERMAL PERMEABILITY b [J/(m² · K · s^0.5)] |
|---|---|---|---|---|---|
| FIXING ROLLER | BASE LAYER | 1000 | 90 | $4.0 \times 10^6$ | 18974 |
| | ELASTIC LAYER | 200 | 0.3 | $1.86 \times 10^6$ | 747 |
| | RELEASE LAYER | 100 | 0.6 | $2.0 \times 10^6$ | 1095 |
| PRESSURE ROLLER | RELEASE LAYER | 50 | 0.2 | $2.3 \times 10^6$ | 678 |
| | ELASTIC LAYER | 200 | 0.3 | $1.86 \times 10^6$ | 747 |
| | BASE LAYER | 1000 | 90 | $4.0 \times 10^6$ | 18974 |

The fixing apparatus 10 is arranged such that the pressure of the nip portion N is 0.4 MPa, the width in the rotational direction of the nip portion N is 4 mm, the peripheral velocity of the fixing roller 1 is 400 mm/sec., and the passing time of the nip portion N is 0.004÷0.4=10 msec. The power applied from the halogen lamp 3 to the fixing roller 1 is Q=2534[W/m]. The temperature just before the nip portion N of the surface of the fixing roller 1 is about 180° C. when the outer surface temperature of the fixing roller 1 becomes a stationary state in a heating process of a continuous sheet.

As shown in FIG. 7A, the toner on the continuous sheet is fully fixed by the parameters set in the first embodiment because the lowest fixing temperature is 176° C. when the thickness d of the release layer 1*a* is 100 μm and the passing time of the nip portion N is 10 msec. At this time, the temperature of the inner surface of the fixing roller 1 is 205° C. and is fully lower than a heat resistant temperature of general silicone rubber of 230° C., so that the elastic layer 1*b* exhibits an enough durability life.

Effect of First Embodiment

It is necessary to lead the heat from the halogen lamp 3 disposed within the fixing roller 1 efficiently toward the surface of the fixing roller 1 which comes in contact with a toner image in order to efficiently fix the non-fixed toner image to a recording medium. That is, it is essential to lower the heat resistance from the inside to the surface of the fixing roller 1. It is possible to improve the heat transfer characteristic of the elastic layer 1*b* by doping the high thermal conductive filler into the elastic layer 1*b* itself. The high thermal conductive filler improves the thermal conductivity of the elastic layer 1*b* and the toner on the recording medium is efficiently heated.

In the case where the release layer 1*a* is layered on the outside of the elastic layer 1*b*, the release layer 1*a* acts as a heat resistant layer, so that the effect of the improvement of the high thermal conductivity of the elastic layer 1*b* cannot be fully utilized depending on the thickness of the release layer 1*a*. Then, it is conceivable to enhance the thermal conductivity of the release layer 1*a* by doping the high thermal conductive filler into the release layer 1*a*. This arrangement makes it possible to improve efficiency of heating the recording medium and to lower the target temperature of the temperature control of the fixing roller 1 while keeping a favorable toner offset performance by the release layer 1*a*.

However, if the thermal conductivity of the release layer 1*a* is enhanced, a new problem occurs concerning the thickness of the release layer 1*a*. In the case where the fixing roller 1 is composed of, from the inside, the base layer 1*c*, the elastic layer 1*b* and the release layer 1*a* and the thermal permeability of the release layer 1*a* is higher than that of the elastic layer 1*b*, the heat transfer characteristic of the release layer 1*a* cannot be fully utilized unless the thickness of the release layer 1*a* is thicker than 50% or more of the thermal diffusion length L of the release layer 1*a*. Then, the thermal permeability of the release layer 1*a* is set to be greater than that of the elastic layer 1*b* and the thickness d of the release layer 1*a* is set to be 50% or more of the thermal diffusion length L in the first embodiment. This configuration realizes the efficient toner fixing condition and permits the lowering of the target temperature in the temperature control of the fixing roller 1.

By the way, if the thickness d of the release layer 1*a* is thickened blindly by exceeding 50% of the thermal diffusion length L, the total heat resistance of the fixing roller 1 including a heat resistance of the elastic layer 1*b* increases. As a result, there is a possibility that the heat resistant temperature of the elastic layer 1*b* exceeds 230° C. if the outer surface temperature of the fixing roller 1 is increased to the temperature necessary for melting the toner. Then, the fixing apparatus 10 of the first embodiment is arranged such that the elastic layer 1*b* of the fixing roller 1 is used under the heat resistant temperature of 230° C. to prevent the life from being shortened by overheat by largely setting the thermal permeability of the release layer 1*a* and by setting the upper limit value of the thickness adequately.

First Comparative Example

The outer surface temperature of the fixing roller is substantially constant in a stationary state even if the thickness d of the release layer 1*a* is changed as shown in FIG. 10. The thickness d of the release layer 1*a* was set at 20 μm in a first comparative example. As shown in FIGS. 6 and 7, the mass is insufficient and the release layer 1*a* cannot exhibit enough heat storage performance with the first comparative example, so that the heat flow rate from the surface of the fixing roller 1 to the toner became insufficient, the toner melted insufficiently, and an output image was fixed insufficiently as a result.

Second Comparative Example

The outer surface temperature of the fixing roller 1 is substantially constant in the stationary state even if the thickness d of the release layer 1*a* is changed as shown in FIG. 10. The thickness d of the release layer 1*a* was set at 600 μm in a second comparative example. In the second comparative example, while the outer surface temperature of the release layer 1*a* was substantially the same with the first embodiment, the temperature of the inner circumferential surface of the base layer 1*c* and the elastic layer 2*b* exceeded 230° C., and the durability life of the fixing roller 1 was remarkably shortened.

Second Embodiment

Figure 12:
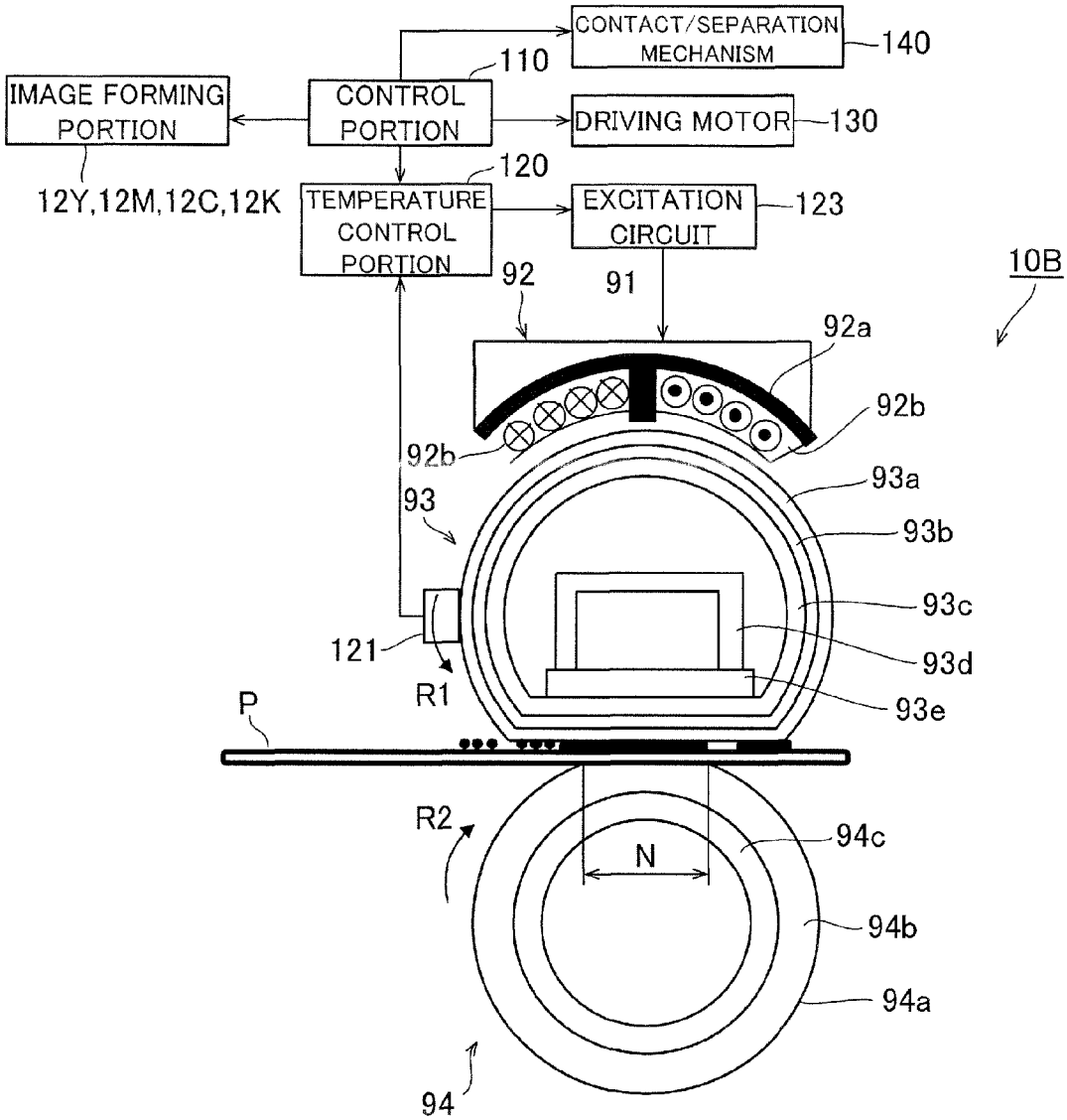
FIG. 12 is a diagram illustrating a configuration of a fixing apparatus of a second embodiment.

In a second embodiment, the fixing apparatus 10 shown in FIG. 1 is replaced with a fixing apparatus 10B shown in FIG. 12 in the image forming apparatus 100 shown in FIG. 1. The fixing apparatus 10B is a belt fixing apparatus configured to form a nip portion of a recording medium by making a pressure roller 94 in contact with a fixing belt 93.

(Fixing Apparatus)

FIG. 12 is a schematic diagram illustrating a configuration of the fixing apparatus of the second embodiment. As shown in FIG. 1, the fixing apparatus 10B fixes an image to a recording medium P by heating and pressing the recording medium P on which a toner image has been transferred at the secondary transfer portion T2.

As shown in FIG. 12, the fixing apparatus 10B is configured to fix an output image on the recording medium P by pressing and heating the recording medium P at a nip portion N formed between the fixing belt 93 and the pressure roller 94.

The fixing belt 93 is 300 mm in length in a width direction orthogonal to the rotational direction and 30 mm in diameter. The fixing belt 93 is composed of a metallic base layer 93*c*, an elastic layer 93*b* made of a rubber material, and a release layer 93*a* made of a fluoro-rubber material. In the fixing belt 93, the elastic layer 93*b* made of silicone rubber of 200 μm in thickness is formed around the base layer 93*c* made of nickel of 0.05 mm in thickness. The elastic layer 93*b* gives flexibility to the fixing belt 93. It is possible to regulate the length in the rotational direction of the nip portion N and the quality of an output image by regulating the thickness and hardness of the elastic layer 93*b*.

The pressure roller 94 rotates in a direction of an arrow R2 by being driven by the driving motor 130. The fixing belt 93 rotates in a direction of an arrow R1 by being driven by the rotation of the pressure roller 94. The pressure roller 94 is 300 mm in length in the width direction orthogonal to the rotational direction and 30 mm in diameter. In the pressure roller 94, an elastic layer 94*b* made of silicone rubber of 200 μm in thickness is formed on a base layer 94*c* made of iron of 1 mm in thickness. A surface of the elastic layer 94*b* is coated by a release layer 94*a* made of fluoro-resin (PFA) of 50 μm in thickness.

A pressing stay 93*d* and a pressing pad 93*e* are disposed non-rotationally in an inner space of the fixing belt 93. A load is applied to the pressing stay 93*d* to press the pressing pad 93*e* to the pressure roller 94 to form the nip portion N between the fixing belt 93 and the pressure roller 94. The pressing pad 93*e* is 324 mm in length. A pressing mechanism (not shown) biases both end portions of the pressing stay 93*d* to apply the load directed to the pressure roller 94 to press the pressing pad 93*e* toward the fixing belt 93. The nip portion N for the recording medium P is formed between the fixing belt 93 being pressed by the pressing pad 93*e* and the pressure roller 94. The pressing pad 93*e* slides on an inner circumferential surface of the fixing belt 93. Silicone grease is applied to the inner circumferential surface of the fixing belt 93 to assure slidability between the pressing pad 93*e* and the inner circumferential surface of the fixing belt 93.

An inductive heating unit 92 is disposed outside of the fixing belt 93. The inductive heating unit 92 generates magnetic fluxes by causing an electric current to flow through a coil 92*b*. The temperature control portion 120 feeds power to the coil 92*b* by controlling an excitation circuit, not shown.

A magnetic flux magnetic core 92*a* guides the magnetic flux generated by the coil 92*b* in a desired direction and inputs to the fixing belt 93. The coil 92*b* generates an alternating magnetic flux by an AC current supplied from the excitation circuit. A magnetic field of the alternating magnetic flux generated by the coil 92*b* is guided by the magnetic core 92*a* and acts on and generates eddy current in the base layer 93*c* of the fixing belt 93.

The eddy current generates Joule heat by the intrinsic resistance of the base layer 93*c*. The fixing belt 93 generates heat by an electromagnetic induction action of the generated magnetic flux by supplying the AC current through the coil 92*b*, so that the fixing belt 93 is inductively heated and the outer surface temperature of the fixing belt 93 rises.

The outer surface temperature of the fixing belt 93 is detected by a temperature sensor 121. The temperature sensor 121 inputs electrical information regarding the detected temperature to a temperature control portion 120. On a basis on the temperature information from the temperature sensor 121, the temperature control portion 120 controls the AC current to be supplied to the coil 92*b* such that the temperature of the fixing belt 93 is kept at the target temperature (fixing temperature) in the temperature control thereof. That is, the temperature control is made by the temperature control portion 120 such that temperature of the fixing belt 93 rises to the fixing temperature set in advance by controlling the power supplied to the coil 92*b* from the excitation circuit (not shown).

(Explanation of Parameter of Heating Belt)

Figure 13:
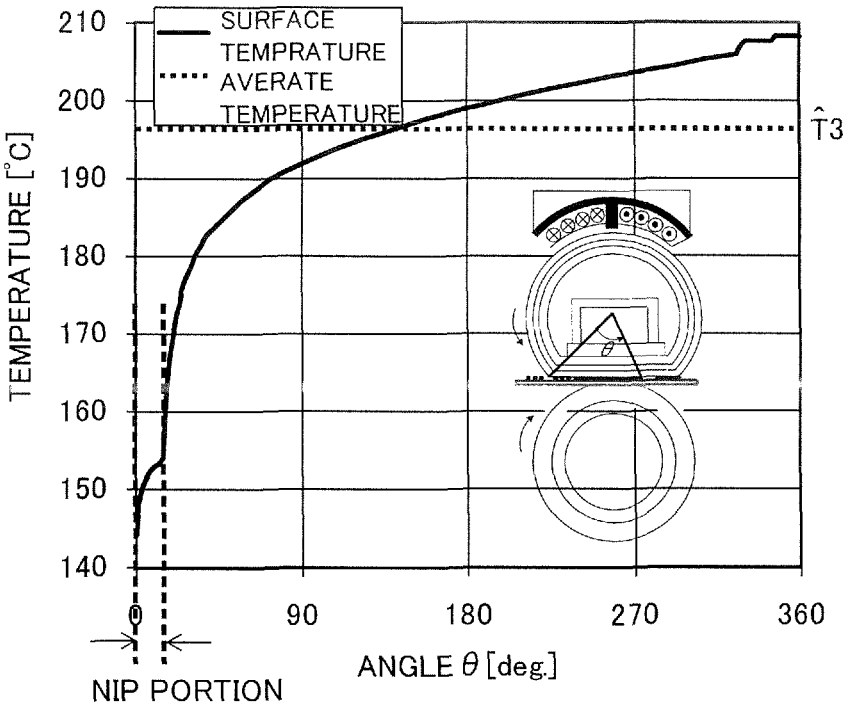
FIG. 13 is a graph illustrating changes of an outer surface temperature in one rotation of a fixing belt.
Figure 14:
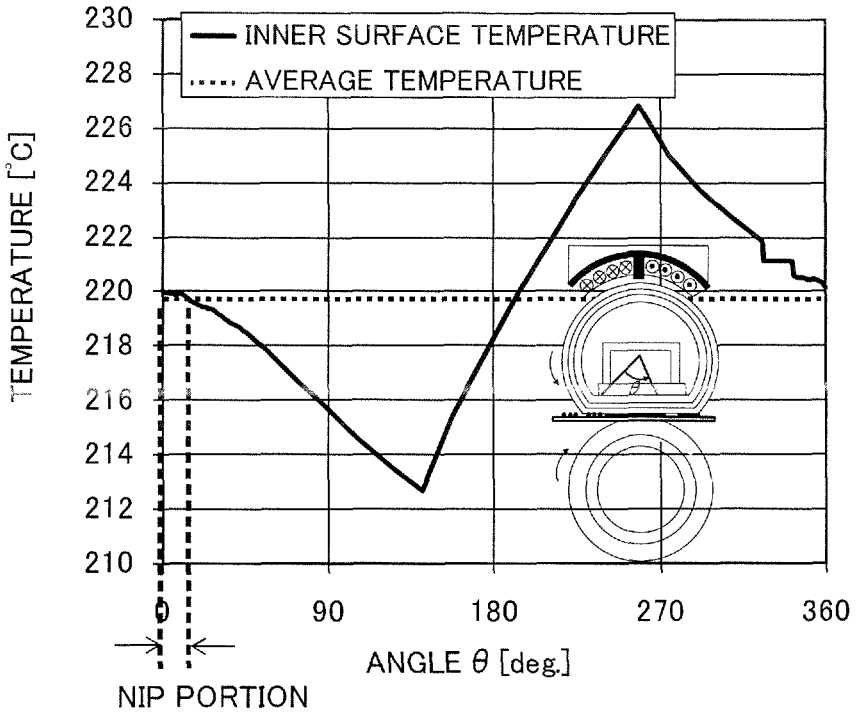
FIG. 14 is a graph illustrating changes of an inner surface temperature in one rotation of the fixing belt.
Figure 15:
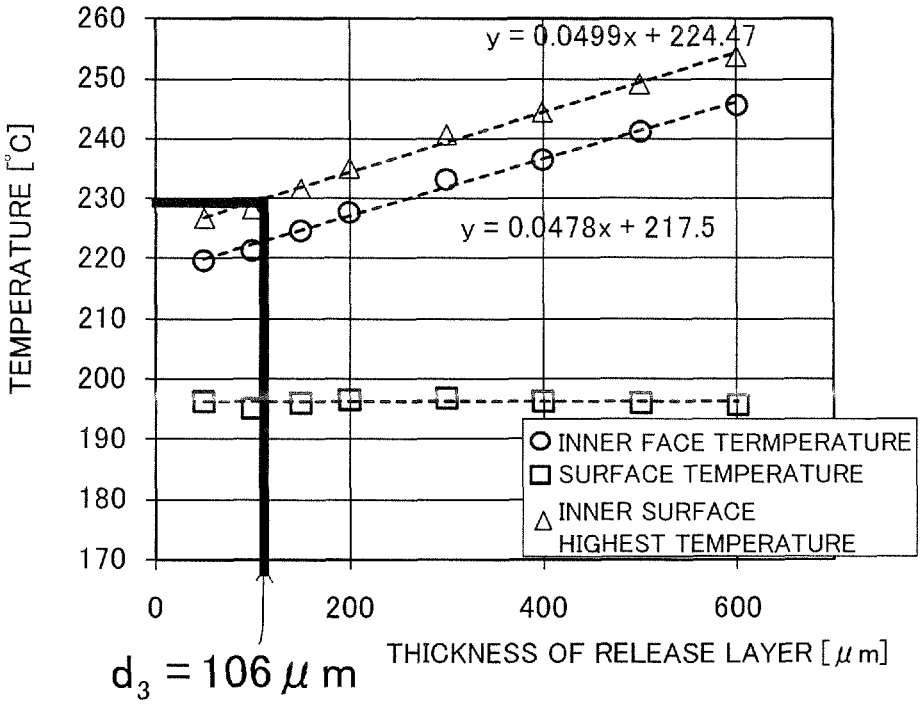
FIG. 15 is a graph illustrating an upper limit value of the thickness of the release layer.
Figure 16:
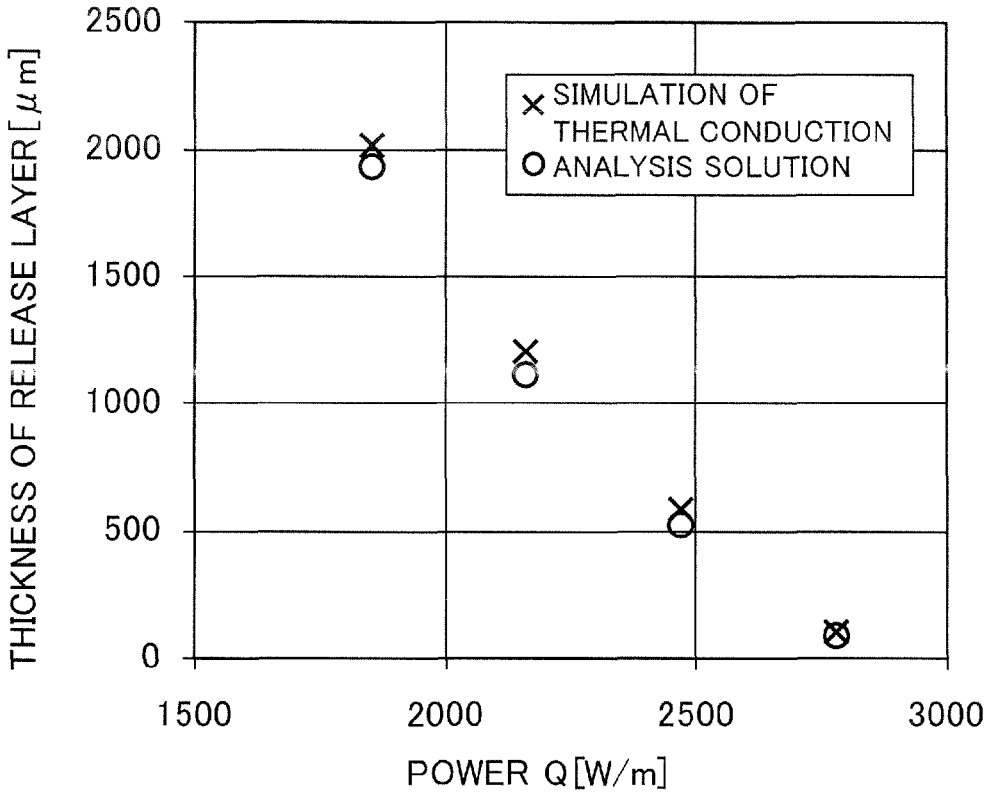
FIG. 16 is a graph illustrating a relationship between the supply power and the maximum allowable thickness of the release layer.

FIG. 13 is a graph illustrating changes of the outer surface temperature in one rotation of the fixing belt, FIG. 14 is a graph illustrating changes of the inner surface temperature in one rotation of the fixing belt, FIG. 15 is a graph illustrating an upper limit value of a thickness of the release layer, and FIG. 16 is a graph illustrating a relationship between a supply power and a maximum allowable thickness of the release layer.

As shown in a graph in FIG. 13, a pattern of changes of the outer surface temperature of the fixing belt in a state in which the changes of the outer surface temperature of the fixing belt 93 are put into a stationary state was simulated in terms of thermal conduction. When a power Q was 2778[W/m] and a thickness d of the release layer 93*a* was 100 μm, a continuous sheet (image interval=0) was heated such that the changes of the outer surface temperature of the fixing belt 93 are constantly repeated in the state. The abscissa axis of the graph represents a rotational angle from a head position of the nip portion N and the ordinate axis represents the outer surface temperature of the fixing belt 93. The broken line is the average value of the outer surface temperature in one rotation.

As shown in FIG. 14, a pattern of changes of the inner surface temperature of the fixing belt 93 in a state in which the changes of the outer surface temperature of the fixing belt 93 are put into the stationary state was simulated in terms of thermal conduction. The conditions were the same with those in FIG. 13. The abscissa axis of the graph represents a rotational angle from a head position of the nip portion and the ordinate axis represents the inner surface temperature of the fixing belt 93. The broken line is the average value of the inner surface temperature similarly to the case of the outer surface temperature.

As shown in FIG. 15, the relationship between the thickness d of the release layer 93*a* of the fixing belt 93 and the inner surface temperature of the fixing belt 93 was studied. Table 6 shows layer structures and thermal physical property values of the fixing belt 93 and the pressure roller 94. As shown in Table 6, the simulation of the thermal conduction was studied by varying the thickness of the release layer 93*a* from 50 to 600 μm. The layer structure of the pressure roller 94 is the same with that shown in Table 4.

TABLE 6

| | | THICKNESS d [μm] | THERMAL CONDUCTIVITY λ [W/(m · K)] | HEAT CAPACITY ρC [J/(m³ · K)] | THERMAL PERMEABILITY b [J/(m² · K · s^0.5)] |
|---|---|---|---|---|---|
| FIXING ROLLER | BASE LAYER | 50 | 75 | $4.7 \times 10^6$ | 18775 |
| | ELASTIC LAYER | 200 | 0.3 | $1.86 \times 10^6$ | 747 |
| | RELEASE LAYER | 50~600 | 0.6 | $2.0 \times 10^6$ | 1095 |
| TONER | TONER | 5 | 0.3 | $1.8 \times 10^6$ | 735 |
| IMAGE | PAPER | 115 | 0.12 | $1.20 \times 10^6$ | 379 |
| PRESSURE ROLLER | RELEASE LAYER | 50 | 0.2 | $2.3 \times 10^6$ | 678 |
| | ELASTIC LAYER | 200 | 0.3 | $1.86 \times 10^6$ | 747 |
| | METALLIC BASE LAYER | 1000 | 90 | $4.0 \times 10^6$ | 18974 |

As shown in FIG. 15, both the inner surface average temperature and the outer surface average temperature of the fixing belt 93 hold a linear relationship to the thickness d of the release layer 93*a*. However, because the inductive heating unit 92 inductively heats the base layer 93*c* partially in a predetermined angular range in one rotation of the fixing belt 93 as shown in FIG. 12, the fixing belt 93 is partially exposed to a temperature considerably higher than the inner surface average temperature as shown in FIG. 14. Due to that, a thermal conduction simulation was carried out also on a maximum temperature of the inner surface temperature shown in FIG. 14 to confirm that a linear relationship holds to the thickness d of the release layer 93*a*.

Accordingly, in the second embodiment, the thickness of the release layer required to keep the temperature of the fixing belt 93 below the heat resistant temperature was estimated based on the linear relationship of the maximum temperature of the inner surface temperature, instead of the linear relationship of the inner surface average temperature of the fixing belt 93. As shown in FIG. 15, the thickness d of the release layer 93*a* should be set below 106 μm in order to keep the maximum temperature $T_{0max}$ of the inner surface temperature below the heat resistant temperature of 230° C. of the silicone rubber.

Such thermal conduction simulations were carried out also in other powers in a range from 1800 to 2800[W/m] to find the maximum allowable thickness of the release layer 93*a* for keeping the inner surface temperature of the fixing belt 93 below 230° C. as shown in FIG. 16.

As shown in FIG. 16, it was found that simulation results (marks x in FIG. 16) of the heat conduction coincide very well with analytical solutions (marks o in FIG. 16) obtained on a basis of Equation 9 described above in the same manner with the first embodiment.

Accordingly, even if the outer surface temperature and inner surface temperature of the fixing roller 1 are inhomogeneous, it is possible to estimate the maximum allowable thickness of the release layer 93*a* considerably accurately by using Equation 9. In the case where the fixing belt 93 is partially heated, the maximum temperature $T_{0max}$ of the inner surface varies by energy density of the partial heating, so that the relationship between the inner surface average temperature and the inner surface maximum temperature should be studied in advance corresponding to the structure of a heat source at each time.

A case where the heating member is composed of n layers can be generalized and summarized as follows, where $\alpha_n$ is thermal diffusivity of the release layer, $b_n$ is thermal permeability of the release layer, and $b_{n-1}$ is thermal permeability of the elastic layer:

$$b_{n-1} < b_n$$

$$\sqrt{\alpha_n t} < d_n < r_n\left[\exp\left\{\lambda_n\left[\frac{2\pi}{Q}(\hat{T}_0 - \hat{T}_n) - \sum_{j=1}^{n-1}\frac{1}{\lambda_j}\ln\frac{r_{j+1}}{r_j}\right]\right\} - 1\right]$$

$\hat{T}_0$ is an inner surface average temperature of the fixing member, $\hat{T}_n$ is an outer surface average temperature of the fixing member, $T_0=\hat{T}_0$ (inner surface average temperature)

$T_n=\hat{T}_n$ (average temperature of outer surface and inner surface)

$$T_{0max}(\epsilon T_0)<230° \text{ C.}$$

$T_{0max}$ is a maximum temperature of the inner circumferential surface, and

230° C. is a heat resistant limit temperature of rubber. . . . Eq. 14

Here, the inductive heating unit 92 eccentrically heats only a part in the rotational direction of the fixing belt 93. Then, an operation condition is set such that the maximum temperature of the inner circumferential surface of the fixing belt 93 is kept below the heat resistant temperature of the $n-1^{-th}$ layer of the fixing belt 93.

This arrangement makes it possible to keep the inner surface temperature of the fixing belt below the heat resistant limit temperature of the silicone rubber material by suppressing the inner surface maximum temperature below 230° C. while fully utilizing the heat transfer characteristic of the release layer in the belt fixing apparatus.

(Specific Configuration of Second Embodiment)

As shown in FIG. 12, the fixing apparatus 10B is constructed such that the pressing force of the nip portion N is 0.4 MPa, the width in the rotational direction of the nip portion N is 4 mm, the rotational speed of the nip portion N is 400 mm/sec., and the passing time t of the nip portion N is 10 msec.

The surface of the elastic layer 93*b* is coated by the release layer 93*a* made of fluoro-rubber of 100 μm in thickness. The high thermal conductive inorganic filler is doped into the release layer 93*a* to enhance the thermal conductivity of the fluoro-rubber. Table 7 shows thermal physical property values of the respective layers of the fixing belt 93 and the pressure roller 94.

The density of each layer was measured by means of an immersion method by using a density meter. The specific heat was measured by using a differential scanning calorimeter (DSC), and the heat capacity was found from a product of the density and the specific heat. The thermal conductivity was measured by using ai-Phase Mobile 2 (ai-Phase Co., Ltd.).

TABLE 7

| | | THICKNESS d [μm] | THERMAL CONDUCTIVITY λ [W/(m · K)] | HEAT CAPACITY ρC [J/(m³ · K)] | THERMAL PERMEABILITY b [J/(m² · K · s^0.5)] |
|---|---|---|---|---|---|
| FIXING ROLLER | BASE LAYER | 50 | 75 | $4.7 \times 10^5$ | 18775 |
| | ELASTIC LAYER | 200 | 0.3 | $1.86 \times 10^6$ | 747 |
| | RELEASE LAYER | 100 | 0.6 | $2.0 \times 10^6$ | 1095 |
| PRESSURE ROLLER | RELEASE LAYER | 50 | 0.2 | $2.3 \times 10^6$ | 678 |
| | ELASTIC LAYER | 200 | 0.3 | $1.86 \times 10^6$ | 747 |
| | METALLIC BASE LAYER | 100 | 90 | $4.0 \times 10^6$ | 18974 |

The power Q applied from the inductive heating unit 92 to the fixing belt 93 is 2534[W/m]. When the process of heating the continuous sheet is carried out and the temperature of the fixing belt 93 is put into the stationary state, the outer surface temperature of the fixing belt 93 at the position just before the nip portion N rises to about 179° C.

As shown in FIG. 7A, the lowest fixing temperature is 176° C. when the thickness of the release layer 93*a* is 100 μm in the case where the nip portion N passing time is 10 msec, so that the toner image is fully fixed by this setting.

Meanwhile, because the part facing to the inductive heating unit 92 of the fixing belt 93 is partially heated, the inner surface temperature is distributed as shown in FIG. 14. The inner surface average temperature of the fixing belt 93 at this time is 203° C. and the inner surface maximum temperature is 209° C., so that they are kept fully lower than the heat resistant temperature of the general silicone rubber of 230° C.

Third Comparative Example

The outer surface temperature of the fixing belt 93 is substantially constant in a stationary state even if the thickness d of the release layer 93*a* is changed as shown in FIG. 15. Then, the thickness d of the release layer 93*a* was thinned to 20 μm in a third comparative example. Then, as shown in FIGS. 6 and 7, heat supplying surplus energy of the fixing belt 93 dropped, the quantity of heat supplied to the toner image became insufficient, and the output image was fixed insufficiently as a result.

Fourth Comparative Example

The thickness d of the release layer 93*a* was increased to 560 μm to increase the heat supplying surplus energy of the fixing belt 93 in a fourth embodiment. While the outer surface temperature of the release layer 93*a* was substantially constant similarly to the second embodiment, the maximum temperature of the base layer 93*c* and the elastic layer 93*b* exceeded 230° C. and the durability life of the fixing belt 93 remarkably dropped in the fourth embodiment.

Third to Fifth Embodiments

Figure 17:
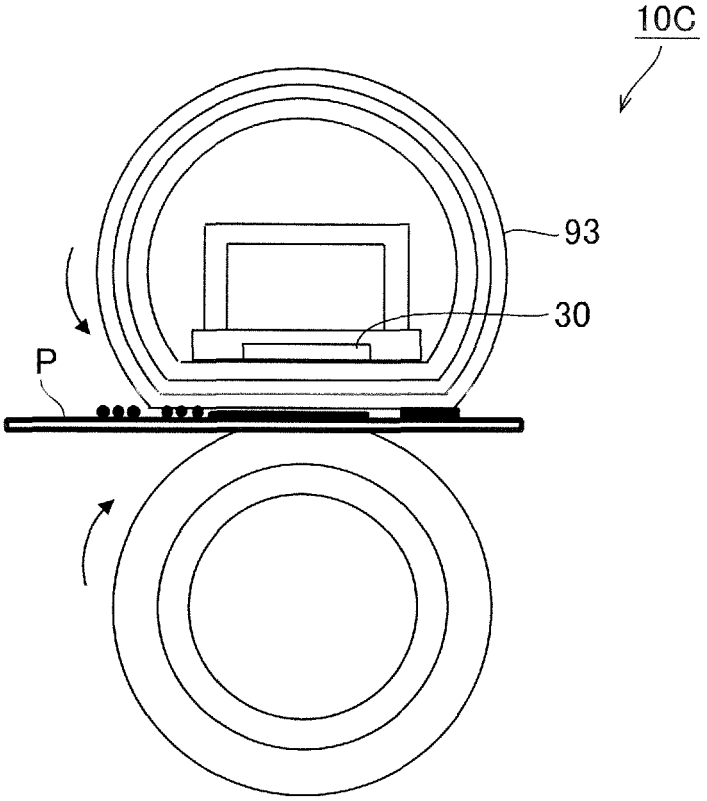
FIG. 17 is a diagram illustrating a configuration of a fixing apparatus of a third embodiment.
Figure 18:
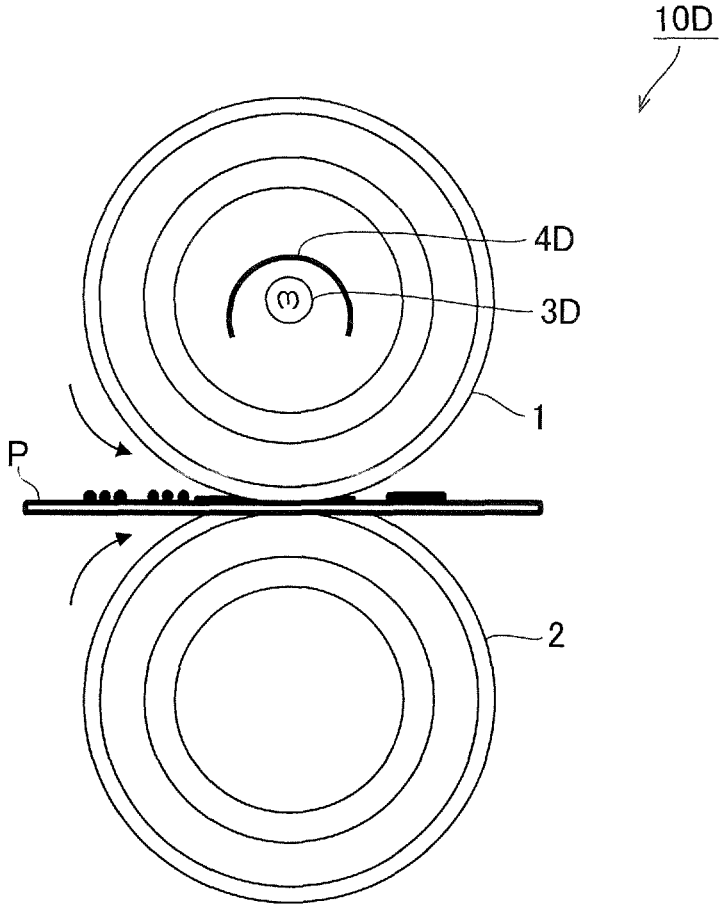
FIG. 18 is a diagram illustrating a configuration of a fixing apparatus of a fourth embodiment.
Figure 19:
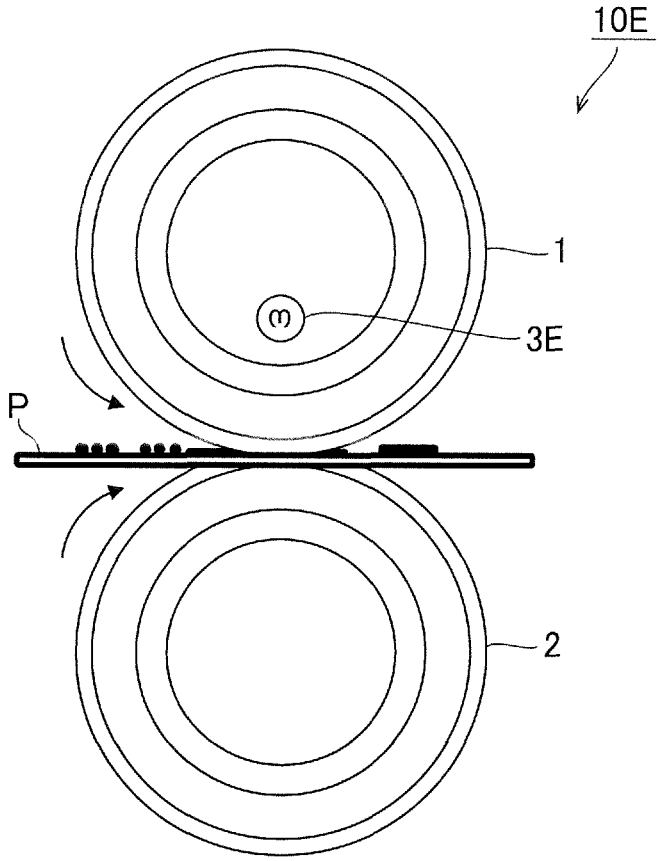
FIG. 19 is a diagram illustrating a configuration of a fixing apparatus of a fifth embodiment.

FIG. 17 is a diagram illustrating a configuration of a fixing apparatus of a third embodiment, FIG. 18 is a diagram illustrating a configuration of a fixing apparatus of a fourth embodiment, and FIG. 19 is a diagram illustrating a configuration of a fixing apparatus of a fifth embodiment.

The inductive heating apparatus was used as the heat source of a part of one rotation of the heating member in the second embodiment. However, the heat source for heating the part of one rotation of the heating member is not limited to the inductive heating apparatus.

For instance, as shown in FIG. 17, a ceramic heater 30 is pressed against the inner surface of the fixing belt 93 to locally heat the fixing belt 93 at the nip portion N in a fixing apparatus 10C of a third embodiment. That is, the ceramic heater 30 has a heating range corresponding to a part in the rotational direction of the fixing belt 93 facing the nip portion N and heats the fixing belt 93 wholly in the rotational direction as the fixing belt 93 rotates.

According to a fixing apparatus 10D of a fourth embodiment, a halogen lamp 3D and a radiant heat reflecting member 4D are provided within the fixing roller 1 to locally heat the fixing roller 1 at the nip portion N as shown in FIG. 18. That is, the halogen lamp 3D has a heating range corresponding to a part in the rotational direction of the fixing roller 1 facing the nip portion N and heats the fixing roller 1 wholly in the rotational direction as the fixing roller 1 rotates.

Further, according to a fixing apparatus 10E of a fifth embodiment, the position where a halogen lamp 3E within the fixing roller 1 is shifted from a center position of the fixing roller 1 to locally heat the fixing roller 1 at the nip portion N as shown in FIG. 19. That is, the halogen lamp 3E has a heating range corresponding to a part in the rotational direction of the fixing roller 1 facing the nip portion N and heats the fixing roller 1 wholly in the rotational direction as the fixing roller 1 rotates.

The temperature of the heating member can be lowered based on the similar equations to those of the second embodiment in the fixing apparatus of the type of partially heating the inner surface of the heating member.

The present invention may be carried out by other modes in which a part or whole of the configuration of the embodiments is replaced with a substitute configuration thereof as long as the heat storage layer is provided on the surface of the heating member and removal of heat and heating of the heat storage layer are repeated in one rotation of the heating member. Accordingly, the present invention can be carried out in any of a roller-roller fixing apparatus, a belt-belt fixing apparatus, a belt-roller fixing apparatus, and a roller-belt fixing apparatus as long as the image heating apparatus includes the heating member having the elastic layer and the release layer. The image heating apparatus is not limited to the fixing apparatus and may be carried out also in an image surface processing apparatus configured to heat a fixed image or a semi-fixed image.

The image heating apparatus may be carried out not only in the mode mounted in an image forming apparatus, but also as a sole processing component or a component linked to another processing unit. While the embodiments of the invention have been described on the main parts related to the formation and transfer of the toner image, the invention may be carried out in various uses such as a printer, various printing machines, a copier, a facsimile, a multi-function printer, and others by adding necessary units, equipment, and a casing structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-081031, filed on Apr. 9, 2013 which is hereby incorporated by reference herein in its entirety.

What is claimed is:

1. An image heating apparatus comprising:

a heat source;

a heating member heated by the heat source; and a conveying member forming a nip portion conveying a recording medium by being in contact with the heating member;

the heating member including a base layer heated by the heat source, an elastic layer disposed on the base layer, and a release layer disposed on the elastic layer, and the heating member satisfying the following equation:

$$\sqrt{\alpha_3 t} \leq d_3$$

where $d_3$[m] is the thickness of the release layer, $\alpha_3$[$m^2$/s] is the thermal diffusivity of the release layer, and t[s] is the recording medium stay time at the nip portion, and wherein the thermal permeability $b_3$ of the release layer is greater than the thermal permeability $b_2$ of the elastic layer, where, $\lambda_2$[W/(m·K)] is the thermal conductivity of the elastic layer, $\rho C_2$[J/($m^3$·K)] is the heat capacity of the elastic layer, $b_2$[J/($m^2$·K·$s^{0.5}$)]($=\sqrt{\lambda_2 \rho C_2}$) is the thermal permeability of the elastic layer, $d_2$[m] is a thickness of the elastic layer, $\lambda_3$[W/(m·K)] is the thermal conductivity of the release layer, $\rho C_3$[J/($m^3$·K)] is the heat capacity of the release layer, and $b_3$[J/($m^2$·K·$s^{0.5}$)]($=\sqrt{\lambda_3 \rho C_3}$) is the thermal permeability of the elastic layer.

2. The image heating apparatus according to claim 1, wherein the heating member is cylindrical, and the heating member satisfies the following equation:

$$d_3 = r_3\left[\exp\left\{\lambda_3\left[\frac{2\pi}{Q}(\hat{T}_0 - \hat{T}_3) - \frac{1}{\lambda_1}\ln\frac{r_2}{r_1} - \frac{1}{\lambda_2}\ln\frac{r_3}{r_3}\right]\right\} - 1\right]$$

where, $r_1$[m] is the inner diameter of the base layer, $r_2$ [m] is the inner diameter of the elastic layer, $r_3$[m] is the inner diameter of the release layer, l [m] is the length in a rotational axis direction of the heating member, Q [W/m] is the power inputted to the heat source per unit length in the rotational axis direction of the heating member, $\hat{T}_3$[° C.] is an outer surface average temperature of the heating member, $\hat{T}_0$[° C.] is an inner surface average temperature of the heating member, $\lambda_1$[W/(m·k)] is the thermal conductivity of the base layer, $\lambda_2$[W/(m·k)] is the thermal conductivity of the elastic layer, and $\lambda_3$[W/(m·k)] is the thermal conductivity of the release layer.

3. An image heating apparatus comprising:

a heat source;

a heating member heated by the heat source; and a conveying member forming a nip portion conveying a recording medium by being in contact with the heating member;

the heating member having a multi-layered structure of n layers in total assigned by layer numbers sequentially from one on the heat source side to the surface in contact with the recording medium, and the heating member satisfying the following equation:

$$\sqrt{\alpha_n t} \leq d_n$$

where $\alpha_n$[$m^2$/s] is thermal diffusivity of the $j^{-th}$ (j=1 to n) layer, $d_n$[m] is a thickness of the $n^{-th}$ layer, and t[s] is the recording medium stay time at the nip portion, wherein the thermal permeability $b_n$ of the $n^{-th}$ layer is greater than the thermal permeability $b_{n-1}$ of the $1-n^{-th}$ layer, where, $\lambda_j$[W/(m·K)] is the thermal conductivity of a $j^{-th}$ (j=1 to n) layer, $\rho C_j$[J/($m^3$·K)] is the heat capacity of the $j^{-th}$ (j=1 to n) layer, $b_j$[J/($m^2$·K·$s^{0.5}$)]($=\sqrt{\lambda_j \rho C_j}$) is the thermal permeability of the $j^{-th}$ (j=1 to n) layer, and $d_j^{[m]}$is a thickness of the $j^{-th}$ (j=1 to n) layer.

4. The image heating apparatus according to claim 3, where an inner diameter of the $j^{-th}$ layer of the heating member formed into the cylindrical shape is denoted as $r_j$[m], the image heating apparatus holding a relationship of the following equation:

$$d_n = r_n\left[\exp\left\{\lambda_n\left[\frac{2\pi}{Q}(\hat{T}_0 - \hat{T}_n) - \sum_{j=1}^{n-1}\frac{1}{\lambda_j}\ln\frac{r_{j+1}}{r_j}\right]\right\} - 1\right]$$

where, l [m] is the length in a rotational axis direction of the heating member, Q [W/m] is the power inputted to the heat source per unit length in the rotational axis direction of the heating member, $\hat{T}_n$[° C.] is the outer surface average temperature of the heating member, $\hat{T}_0$[° C.] is the inner surface average temperature of the heating member, $r_j$[m] is an inner diameter of the $J^{-th}$ layer, and $\lambda_j$[W/(m·k)] is the thermal conductivity of the $j^{-th}$ layer.

5. The image heating apparatus according to claim 2, wherein the heat source heats the heating member homogeneously wholly in the rotational direction, and wherein the average temperature of the inner circumferential surface of the heating member is less than the heat resistant temperature of the elastic layer of the heating member in an operation state defined by the equation recited in claim 2.

6. The image heating apparatus according to claim 4, wherein the heat source heats the heating member homogeneously wholly in the rotational direction, and wherein the average temperature of the inner circumferential surface of the heating member is less than the heat resistant temperature of a second layer from an inside of the heating member in an operation state defined by the equation recited in claim 4.

7. The image heating apparatus according to claim 2, wherein the heat source has a heating range corresponding to a part in the rotational direction of the heating member and heats the heating member wholly in the rotational direction as the heating member rotates, and wherein the maximum temperature of the inner circumferential surface of the heating member is less than the heat resistant temperature of the elastic layer of the heating member in the operation state defined by the equation recited in claim 2.

8. The image heating apparatus according to claim 4, wherein the heat source heats has a heating range corresponding to a part in the rotational direction of the heating member and heats the heating member wholly in the rotational direction as the heating member rotates, and wherein the maximum temperature of the inner circumferential surface of the heating member is less than the heat resistant temperature of a second layer from an inside of the heating member in the operation state defined by the equation recited in claim 4.

9. The image heating apparatus according to claim 1, wherein the elastic modulus of the elastic layer on which the release layer is disposed is smaller than the elastic modulus of the release layer, and wherein the contact angle of the surface of the release layer to melted toner is larger than the contact angle of the surface of the elastic layer to the melted toner of the same temperature.

10. The image heating apparatus according to claim 2, wherein the elastic modulus of the elastic layer on which the release layer is disposed is smaller than the elastic modulus of the release layer, and wherein the contact angle of the surface of the release layer to melted toner is larger than the contact angle of the surface of the elastic layer to the melted toner of the same temperature.

11. The image heating apparatus according to claim 3, wherein the elastic modulus of the $n-1^{-th}$ layer is smaller than the elastic modulus of the $n^{-th}$ layer, and wherein the contact angle of the surface of the $n^{-th}$ layer to melted toner is larger than the contact angle of the surface of the $n-1^{-th}$ layer to the melted toner of the same temperature.

12. The image heating apparatus according to claim 4, wherein the elastic modulus of the $n-1^{-th}$ layer is smaller than the elastic modulus of the $n^{-th}$ layer, and wherein the contact angle of the surface of the $n^{-th}$ layer to melted toner is larger than the contact angle of the surface of the $n-1^{-th}$ layer to the melted toner of the same temperature.

* * * * *